US010494147B2

(12) United States Patent
Nakano et al.

(10) Patent No.: US 10,494,147 B2
(45) Date of Patent: Dec. 3, 2019

(54) PACKAGED ARTICLE

(71) Applicants: MIZKAN HOLDINGS CO., LTD., Handa-shi, Aichi (JP); MIZKAN CO., LTD., Handa-shi, Aichi (JP)

(72) Inventors: Shigeru Nakano, Handa (JP); Masanori Shinohara, Handa (JP)

(73) Assignees: MIZKAN HOLDINGS CO., LTD., Handa-shi (JP); MIZKAN CO., LTD., Handa-shi (JP)

( * ) Notice: Subject to any disclaimer, the term of this patent is extended or adjusted under 35 U.S.C. 154(b) by 0 days.

(21) Appl. No.: 15/681,510

(22) Filed: Aug. 21, 2017

(65) Prior Publication Data

US 2017/0341819 A1 Nov. 30, 2017

Related U.S. Application Data

(63) Continuation of application No. PCT/JP2016/053997, filed on Feb. 10, 2016.

(30) Foreign Application Priority Data

Feb. 24, 2015 (JP) ..... 2015-033871

(51) Int. Cl.
*B65D 33/01* (2006.01)
*B65D 35/44* (2006.01)
(Continued)

(52) U.S. Cl.
CPC ..... *B65D 33/01* (2013.01); *B65D 35/44* (2013.01); *B65D 75/20* (2013.01); *B65D 75/58* (2013.01);
(Continued)

(58) Field of Classification Search
CPC .... B65D 33/01; B65D 35/44; B65D 75/5822; B65D 75/5805; B65D 25/52; B65D 81/3461; B65D 81/3266; B65D 77/38
See application file for complete search history.

(56) References Cited

U.S. PATENT DOCUMENTS 2,325,021 A * 7/1943 Salfisberg ..... B65D 75/38 206/466
4,770,295 A * 9/1988 Carveth ..... B29C 66/72343 156/273.7
(Continued)

FOREIGN PATENT DOCUMENTS

EP 2658793 11/2013
JP 2000-007027 A 1/2000
(Continued)

OTHER PUBLICATIONS

Office Action dated Sep. 10, 2019 in Japanese Application No. 2015-033871.

*Primary Examiner* — David P Angwin
*Assistant Examiner* — Bob Zadeh
(74) *Attorney, Agent, or Firm* — Foley & Lardner LLP

(57) ABSTRACT

A packaged article includes a packing bag which includes a welded portion that hermetically seals a container compartment in which a fluid content is contained. The welded portion includes a weak sealant section configured to be parted when the container compartment is pressed to communicate the container compartment and the exterior of the packing bag. A strong sealant section is configured to maintain a welded state at the time when the weak sealant section is parted. The container compartment includes a primary container section and a secondary container section. The secondary container section includes a narrow neck that is narrower than the primary container section in a widthwise direction, which corresponds to a direction in which the
(Continued)

weak sealant section extends. The secondary container section is in communication with the primary container section at the narrow neck. The secondary container section is located adjacent to the weak sealant section.

24 Claims, 17 Drawing Sheets

(51) Int. Cl.

| | |
|---|---|
| ***B65D 75/58*** | (2006.01) |
| ***B65D 75/20*** | (2006.01) |
| *B65D 25/52* | (2006.01) |
| *B65D 77/38* | (2006.01) |
| *B65D 81/32* | (2006.01) |
| *B65D 81/34* | (2006.01) |

(52) U.S. Cl.
CPC ..... *B65D 75/5805* (2013.01); *B65D 75/5822* (2013.01); *B65D 25/52* (2013.01); *B65D 77/38* (2013.01); *B65D 81/3266* (2013.01); *B65D 81/3461* (2013.01)

(56) References Cited

U.S. PATENT DOCUMENTS

| | | | | |
|---|---|---|---|---|
| 5,894,929 | A * | 4/1999 | Kai | B65D 81/3461 206/524.8 |
| 6,276,529 | B1 * | 8/2001 | Feehan, Jr. | B65D 75/32 206/352 |
| 6,655,837 | B2 * | 12/2003 | Matsuda | B65D 75/5866 383/104 |
| 7,040,483 | B2 * | 5/2006 | Inuzuka | B65D 75/5855 206/219 |
| 8,434,637 | B2 * | 5/2013 | Mita | B32B 27/08 220/495.03 |
| 2001/0000042 | A1 * | 3/2001 | Inuzuka | A61J 1/2093 604/410 |
| 2005/0177128 | A1 * | 8/2005 | Nagao | A61J 1/2093 604/411 |
| 2007/0274615 | A1 * | 11/2007 | Deniaud | B65D 75/008 383/207 |
| 2007/0278114 | A1 | 12/2007 | Kane et al. | |
| 2009/0254032 | A1 * | 10/2009 | Muramatsu | A61J 1/2093 604/87 |
| 2009/0266036 | A1 * | 10/2009 | Zerfas | B65B 9/042 53/469 |
| 2010/0209025 | A1 * | 8/2010 | Futase | B65D 75/008 383/113 |
| 2011/0022022 | A1 * | 1/2011 | Tsuruoka | A61J 1/10 604/410 |
| 2014/0175124 | A1 | 6/2014 | Nathan | |
| 2014/0197202 | A1 * | 7/2014 | Soh | B65D 75/5822 222/107 |
| 2015/0183555 | A1 * | 7/2015 | Mitsui | B65D 33/2533 383/10 |
| 2017/0341819 | A1 * | 11/2017 | Nakano | B65D 33/01 |

FOREIGN PATENT DOCUMENTS

| | | | |
|---|---|---|---|
| JP | 2000-327044 | A | 11/2000 |
| JP | 2007-217052 | | 8/2007 |
| JP | 2014-501674 | A | 1/2014 |
| JP | 2014-058338 | A | 4/2014 |

* cited by examiner

PACKAGED ARTICLE

CROSS-REFERENCE TO RELATED APPLICATIONS

This application is a continuation application of International Application No. PCT/JP2016/053997, filed on Feb. 10, 2016, which is based upon and claims the benefit of priority from the prior Japanese Patent Application No. 2015-033871, filed on Feb. 24, 2015, the entire contents of which are incorporated herein by reference.

TECHNICAL FIELD

The present invention relates to a packaged article that includes a container compartment, which is pressed to open the packaged article.

BACKGROUND ART

A packaged article may include a packing bag that has a welded portion, which hermetically seals a container compartment. Structures that simplify the task for opening such a packaged article have been proposed in the prior art. Patent document 1 discloses an example of a packing bag that includes a weak sealant section and a strong sealant section. When the container compartment is pressed to open the packing bag, only the weak sealant section is released from welding.

PRIOR ART DOCUMENT

Patent Document

Patent Document 1: Japanese Laid-Open Patent Publication No. 2014-058338

SUMMARY OF THE INVENTION

With the packing bag of patent document 1, when pressing of the container compartment is started, the packing bag is bent at a boundary portion of the weak sealant section and the container compartment. This may cause a discharge direction of the content to be unstable.

Another known packing bag includes a welded portion that does not include a strong sealant section and only includes a weak sealant section. The direction in which the content is discharged from such a packing bag is also unstable. This is not desirable.

It is an object of the present invention to provide a packaged article that is configured to stabilize the direction in which a content is discharged from the packaged article when a container compartment of the packaged article is pressed to open the packaged article.

One aspect of the present invention is a packaged article that includes a packing bag, which includes a welded portion that hermetically seals a container compartment, and a fluid content, which is contained in the container compartment. The welded portion includes a weak sealant section, which is configured to be parted when the container compartment is pressed to communicate the container compartment and the exterior of the packing bag, and a strong sealant section, which is configured to maintain a welded state at the time when the weak sealant section is parted. the container compartment includes a primary container section and a secondary container section. The secondary container section includes a narrow neck that is narrower than the primary container section in a width-wise direction, which corresponds to a direction in which the weak sealant section extends. The secondary container section is in communication with the primary container section at the narrow neck. The secondary container section is located adjacent to the weak sealant section.

The above structure limits bending of the boundary portion of the container compartment and the weak sealant section when the primary container section is pressed.

Preferably, in the above packaged article, when a maximum width of the primary container section is set as 100%, a minimum width of the narrow neck of the secondary container section is in a range of 30% or greater and 90% or less.

Preferably, in the above packaged article, the secondary container section is one of a first secondary container section, which is formed by the narrow neck that has a fixed width, and a second secondary container section, which includes a portion that is wider than the minimum width and located between a part of the narrow neck having the minimum width and the weak sealant section.

Preferably, in the above packaged article, the narrow neck of the secondary container section has a shape narrowed from opposite sides of the primary container section in the width-wise direction.

Preferably, in the above packaged article, the narrow neck of the secondary container section is symmetrical with respect to an imaginary plane that is orthogonal to the width-wise direction.

Preferably, in the above packaged article, when a maximum height of the container compartment is set as 100%, a maximum height of the secondary container section is in a range of 2.5% or greater and 35% or less.

Preferably, in the above packaged article, an edge of the strong sealant section defining the narrow neck of the secondary container section satisfies at least one of condition A, condition B, and condition C described below.

Condition A: the edge includes a first straight portion and a second straight portion, which is non-parallel to the first straight portion, in a front view, and the first straight portion and the second straight portion form a first angle $\theta 1$ of $30° \leq \theta 1 < 180°$.

Condition B: the edge includes only a curved portion in the front view, and a first tangent line at any point of the curved portion intersects with a second tangent line at another any point of the curved portion at a second angle $\theta 2$ having a minimum angle of $\theta 2 < 90°$.

Condition C: the edge includes a curved portion and a straight portion in the front view, and a tangent line at any point of the curved portion and the straight portion form a third angle $\theta 3$ having a minimum angle of $\theta 3 < 90°$.

Effect of the Invention

The aspects of the present invention produce the effect for stabilizing the discharge direction of the fluid content when the container compartment is pressed to open the packaged article. Other aspects and advantages of the present invention will become apparent from the following description, taken in conjunction with the drawings, illustrating by way of example the principles of the invention.

EMBODIMENTS OF THE INVENTION

Figure 1A:
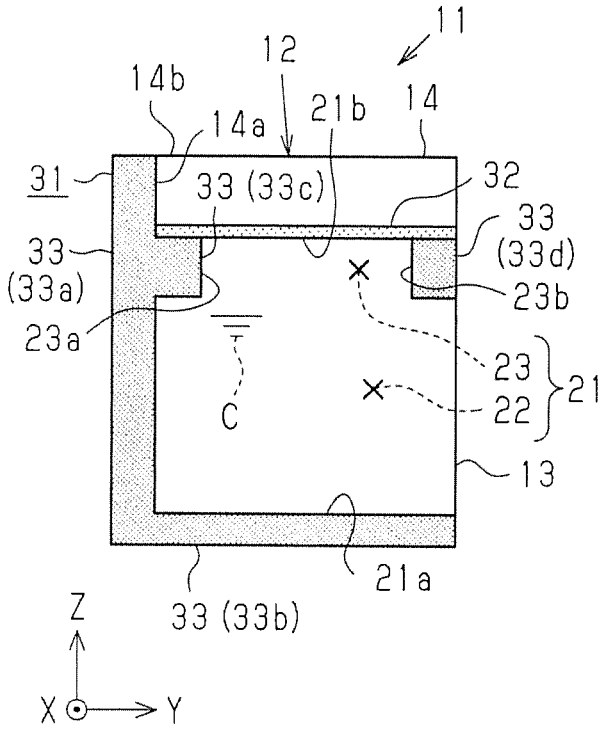
FIG. 1A is a schematic diagram showing one embodiment of a packaged article.

One embodiment of a packaged article will now be described with reference to the drawings.

End surfaces of the packaged article shown in the drawings may be simplified or exaggerated. Additionally, the packaged article is partially shown by screentone to facilitate understanding of the structure of the packaged article. In this specification, the geometry of the packing bag or the packaged article may be described based on the XYZ axes that represent the orthogonal coordinate system of FIG. 1A. The Y-axis of FIG. 1A may be referred to as the width-wise direction or the lateral direction. The Z-axis may be referred to as the height-wise direction or the longitudinal direction. The X-axis may be referred to as the thickness-wise direction. The dimension or distance that extends along the Y-axis may be referred to as the width. The dimension or distance that extends along the Z-axis may be referred to as the height. The dimension or distance that extends along the X-axis may be referred to as the thickness.

Entire Structure

As shown in FIG. 1A, a packaged article 11 includes a packing bag 12 and a fluid content C, which is contained in a container compartment 21 of the packing bag 12. The packing bag 12 may be manufactured by welding a base member so that the packing bag 12 or the container compartment 21 has a desired shape. the container compartment 21 of the packing bag 12 is defined and hermetically sealed by a welded portion 31, formed by welding the base member. The welded portion 31 includes a weak sealant section 32 and a strong sealant section 33. The weak sealant section 32 is configured to be parted when the container compartment 21 is pressed to communicate the container compartment 21 and the exterior of the packing bag 12. The strong sealant section 33 is configured to maintain the welded state at the time when the weak sealant section 32 is parted. The packing bag 12 of the present embodiment is a three-side sealed packing bag formed by half-folding the base member along a folded side 13. As shown in 2B, the base member may be a single film that includes a first panel 12*a* and a second panel 12*b*, which respectively provide a front surface and a rear surface of the packing bag 12. The container compartment 21 is defined between the two panels.

Welded Portion

The strong sealant section 33 includes a longitudinal sealant section 33*a*, which is formed along the side (left side) opposite to the folded side 13, and a lateral sealant section 33*b*, which is formed along the lower side of the packing bag 12. The strong sealant section 33 also includes a first sealant section 33*c*, which projects from the longitudinal sealant section 33*a* toward the folded side 13, and a second sealant section 33*d*, which projects from the folded side 13 toward the longitudinal sealant section 33*a*.

The weak sealant section 32 is opposed to the lateral sealant section 33*b* and spaced apart from the lateral sealant section 33*b*. The weak sealant section 32 extends to connect the first sealant section 33*c* (longitudinal sealant section 33*a*) and the second sealant section 33*d* (folded side 13). The weak sealant section 32 seals a non-welded region surrounded by the strong sealant section 33 and the folded side 13. This forms the container compartment 21. The container compartment 21 may be referred to as the hermetic compartment. The weak sealant section 32 may be referred to as the weak welded strip.

The packing bag 12 of the present embodiment further includes an inlet 14, into which the content C flows from the container compartment 21. The inlet 14 includes a flow passage 14*a*, through which the content C flows, and an opening 14*b*, which discharges the content C out of the packing bag 12. The flow passage 14*a* is located between the longitudinal sealant section 33*a* and the folded side 13 at the downstream side of the weak sealant section 32. The flow passage 14*a* and the container compartment 21 are defined by the weak sealant section 32. The opening 14*b* may be referred to as the outlet.

Container Compartment

The container compartment 21 includes a primary container section 22 and a secondary container section 23, which includes a narrow neck that is narrower than the primary container section 22 in a direction in which the weak sealant section 32 extends (width-wise direction Y in illustrated example). The secondary container section 23 is in communication with the primary container section 22 at the narrow neck. The secondary container section 23 is located adjacent to the weak sealant section 32. The container compartment 21 includes a first inner edge 21*a*, which is formed by the strong sealant section 33 (lateral sealant section 33*b*) opposed to the weak sealant section 32, and a second inner edge 21*b*, which is formed by the weak sealant section 32.

The secondary container section 23 will now be described further in detail.

To more specifically describe the secondary container section 23, side edges of the secondary container section 23 of the present embodiment includes a first side edge 23*a*, which is formed by the first sealant section 33*c*, and a second side edge 23*b*, which is formed by the second sealant section 33*d*.

Figure 1B:
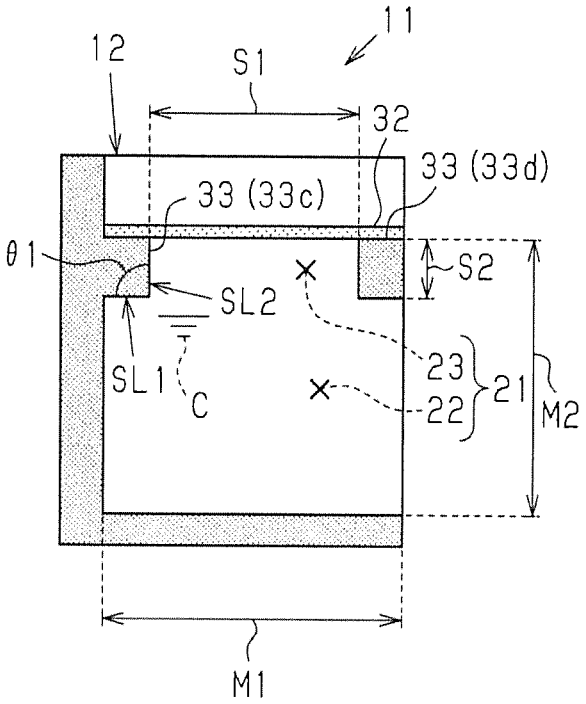
FIG. 1B is a schematic diagram showing the dimensions and angle of the packaged article.

As shown in FIG. 1B, the secondary container section 23 includes the narrow neck having a minimum width S1. The minimum width S1 is the minimum width of the secondary container section 23. When a maximum width M1 of the primary container section 22 is set as 100%, the minimum width S1 is, preferably, in a range of 30% or greater and 90% or less, and more preferably, in a range of 65% or greater and 90% or less. It is further preferred that the minimum width S1 be in a range of 77% or greater and 90% or less. It is preferred that the maximum width M1 of the primary container section 22 be in a range of 10 mm or greater and 100 mm or less.

Figure 1C:
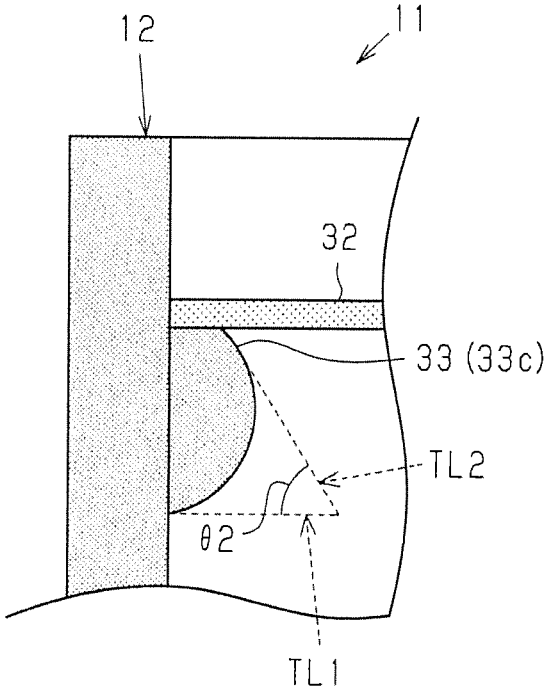
FIGS. 1C and 1D are partially enlarged views showing the geometric shapes of modified examples of a packaged article.
Figure 1D:
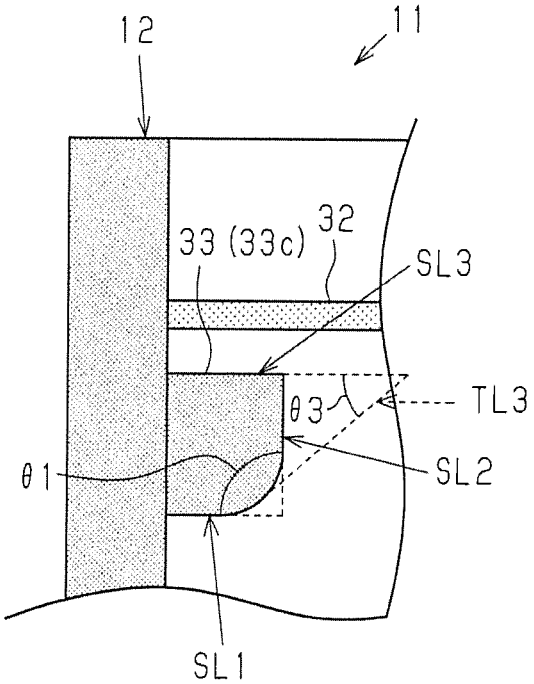

As shown in FIG. 1A, it is preferred that the secondary container section 23 include a first secondary container section formed by the narrow neck having a fixed width. Alternatively, as shown in FIGS. 1C and 1D, it is preferred that the secondary container section 23 include a second secondary container section having a portion that is wider than the minimum width of the narrow neck and located between the part of the narrow neck having the minimum width and the weak sealant section 32.

It is preferred that the narrow neck of the secondary container section 23 has a shape narrowed from opposite sides of the primary container section 22 in the width-wise direction Y. In other words, it is preferred that the narrow neck of the secondary container section 23 correspond to a non-welded portion that extends between the first sealant section 33*c* and the second sealant section 33*d*, which are projected and opposed to each other in the width-wise direction Y of the container compartment 21. Additionally, it is preferred that the narrow neck of the secondary container section 23 be symmetrical with respect to an imaginary plane that is orthogonal to the width-wise direction Y.

When a maximum height M2 of the container compartment 21 is set as 100%, a maximum height S2 of the narrow neck of the secondary container section 23 is, preferably, in a range of 2.5% or greater and 35% or less, and more preferably, in a range of 5% or greater and 15% or less. It is further preferred that the maximum height S2 be in a range of 5% or greater and 12.5% or less. It is preferred that the maximum height M2 of the container compartment 21 be in a range of, for example, 10 mm or greater and 100 mm or less.

It is preferred that the strong sealant section 33 (at least one of first sealant section 33*c* and second sealant section 33*d*), which defines the narrow neck of the secondary container section 23, include an edge that satisfies at least one of condition A, condition B, and condition C described below.

Condition A: As shown in FIG. 1B, the above edge includes a first straight portion SL1 and a second straight portion SL2, which is non-parallel to the first straight portion SL1, in a front view. The first straight portion SL1 and the second straight portion SL2 form a first angle θ1 of $30° \leq \theta 1 < 180°$.

In condition A, the first angle θ1 is, more preferably, $60° \leq \theta 1 \leq 120°$, and further preferably, $80° \leq \theta 1 \leq 100°$ where the first angle θ1 is substantially orthogonal.

Condition B: As shown in FIG. 1C, the above edge is formed by only a curved line in a front view. A first tangent line TL1 at any point of the curved line intersects with a second tangent line TL2 at another any point of the curved line at a second angle θ2. The second angle θ2 has the minimum angle of $\theta 2 < 90°$.

In condition B, more preferably, the second angle θ2 is $\theta 2 \leq 60°$. The curved line of condition B is bulged from the outer edge of the packing bag 12 toward the secondary container section 23.

Condition C: As shown in FIG. 1D, the above edge includes a curved portion and a third straight portion SL3, which is a top edge, in a front view. A third angle θ3 is formed by a third tangent line SL3 at any point of the curved portion and an extension line of the third straight portion SL3. The third angle θ3 has the minimum angle of $\theta 3 < 90°$. The curved line of condition C is bulged from the outer edge of the packing bag 12 toward the secondary container section 23.

As shown in FIG. 1D, the edge of the strong sealant section 33, which forms the narrow neck of the secondary container section 23, includes the first straight portion SL1 and the second straight portion SL2 in a front view. Thus, the minimum angle of one of the first angle θ1 and the third angle θ3 can be determined based on the corresponding one of condition A and condition C and set so that the one of condition A and condition C is satisfied.

As shown in FIG. 1B, it is preferred that the edge of the strong sealant section 33, which forms the secondary container section 23, satisfy condition A and that the first straight portion SL1 form the boundary portion of the primary container section 22 and the secondary container section 23 while the second straight portion SL2 forms the side edge of the narrow neck of the secondary container section 23.

It is preferred that the narrow neck of the secondary container section 23 be located close to the weak sealant section 32. For example, in a plan view of the packing bag 12 that is not filled with the content C and is flat, it is preferred that the end of the narrow neck of the secondary container section 23 located closer to the first inner edge 21*a* be located close to the weak sealant section 32.

When the maximum height M2 of the container compartment 21 is set as 1000, it is preferred that the distance between the weak sealant section 32 and the end of the narrow neck of the secondary container section 23 located closer to the first inner edge 21*a* be 35% or less.

Content

The fluid content C contained in the packing bag 12 is not particularly limited as long as the content C is fluid. The content C may be liquid, gel, or a paste. It is preferred that the viscosity of the content C (e.g., viscosity at 20° C.) be in a range of 0 to 20000 cP. The content C may contain solid matter (e.g., solid matter of 1 mm or smaller).

The content C is, for example, beverage or food. The beverage or food is, for example, a liquid condiment added to natto or a condiment such as mustard. Additionally, the packing bag 12 may be filled with gas instead of the content C. Such gas is not particularly limited as long as the gas is industrially applicable. The gas is, for example, inert gas such as carbon dioxide, argon gas, or nitrogen gas or air.

When the content C is beverage or food, the maximum dimension of the packing bag 12 is, preferably, 500 mm or less, and more preferably, 300 mm or less. Recent increases in health consciousness have increased the demand for a packaged article that divides the condiment into small portions to minimize a salt intake amount. In such a packaged article, the maximum dimension of the packing bag is often set to, for example, 150 mm or less. It is advantageous to apply the packaged article 11 of the present embodiment to such a packaged article.

Base Member

A resin film is used as the base member that forms the packing bag 12. One example of the resin film is a lamination film including a base film layer and a sealant layer. Another example of the resin film is a lamination film including a base film layer, a sealant layer, and an intermediate layer, which is located between the base film layer and the sealant layer.

The resin that forms the base film layer is, for example, an olefin resin such as polyethylene or polypropylene, an ethylene-vinyl alcohol copolymer, polyester, polyamide, polyimide, or vinylidene chloride. The resin that forms the sealant layer is, for example, a polyolefin resin such as polyethylene or polypropylene. The material that forms the intermediate layer is, for example, silica, aluminum oxide, aluminum, or vinylidene chloride. The base member may be a single-layer film. The base member is appropriately selected from base members, each of which has a thickness in a range of, for example, 6 to 300 μm.

The welded portion 31 of the base member may be formed using, for example, high frequency waves, ultrasonic waves, or external heating (heat sealing).

The welded portion is formed by heat sealing, which heats the overlapped base member with a die while applying pressure. When the strong sealant section 33 is formed, the temperature of the die is set to, for example, a range of 100° C. or higher and 180° C. or lower, and the pressure of the die is set to, for example, 100 kPa or higher and 500 kPa or lower. When the weak sealant section 32 is formed, the temperature of the die is set to, for example, a range of 70° C. or higher and 140° C. or lower, and the pressure of the die is set to, for example, 100 kPa or higher and 500 kPa or lower.

For example, to further facilitate the parting of the weak sealant section 32, the base member may undergo plasma processing or the like in advance. The plasma processing may be performed on only a portion of the base member where the weak sealant section 32 is to be formed. Alternatively, the plasma processing may be performed on the entire base member.

It is preferred that the weak sealant section 32 be formed so that the anti-bag breakage strength of the packaged article 11 is in a range of 1 kgf or greater and 4 kgf or less. It is further preferred that the anti-bag breakage strength be 2 kgf or greater and 3 kgf or less. The weak sealant section 32 welds the first panel 12*a* and the second panel 12*b* with a first welding strength, which corresponds to the anti-bag breakage strength of the packaged article 11. The strong sealant section 33 welds the first panel 12*a* and the second panel 12*b* with a second welding strength, which is greater than the first welding strength, so that the welded state of the strong sealant section 33 is maintained at the time when the weak sealant section 32 is parted. It is preferred that the second welding strength corresponds to an anti-bag breakage strength of, for example, 5 kgf or greater.

Operation

The operation of the packaged article 11 of the present embodiment will now be described.

Figure 2A:
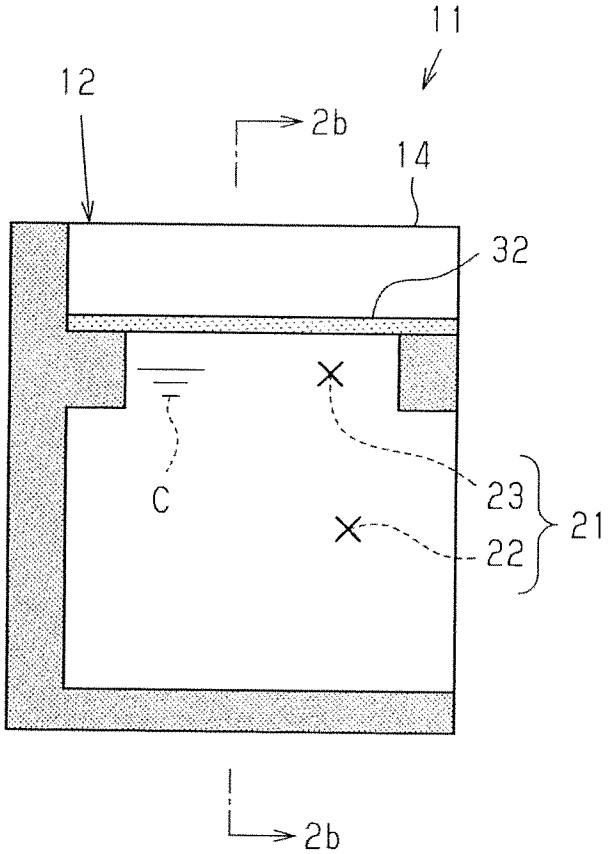
FIG. 2A is a schematic diagram showing the packaged article of the embodiment.
Figure 2B:
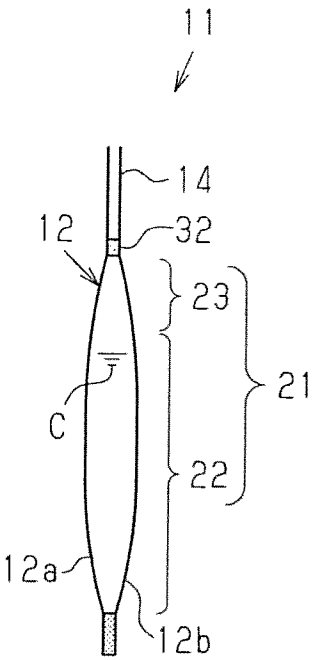
FIG. 2B is a schematic cross-sectional view taken along line 2*b*-2*b* in FIG. 2A.
Figure 2C:
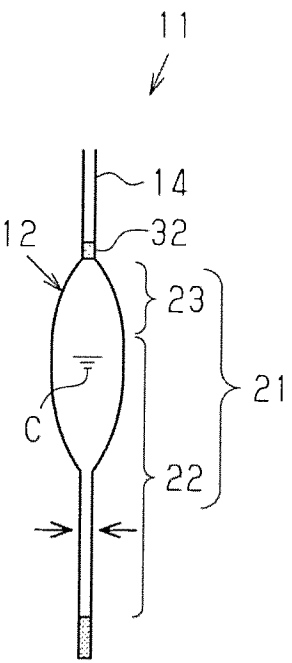
FIG. 2C is a schematic cross-sectional view illustrating a pressing operation performed to open the packaged article.
Figure 2D:
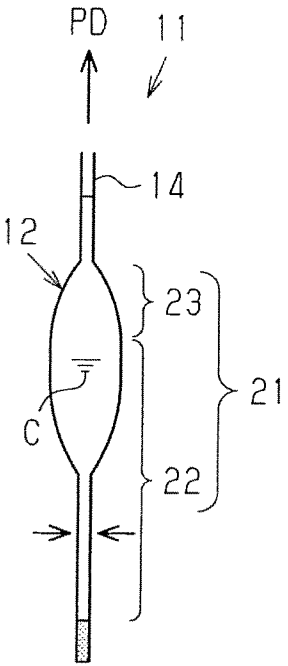
FIG. 2D is a schematic cross-sectional view of the packaged article that is open.

To open the packaged article 11, which is shown in FIGS. 2A and 2B, and force the content C out of the packaged article 11, the primary container section 22 is first pressurized (compressed) as indicated by the arrows in FIG. 2C. The primary container section 22 may be pressurized, for example, holding the primary container section 22, for example, between fingers of the hand so that the first panel 12*a* and the second panel 12*b* of the packing bag 12 become closer to each other. The pressuring of the primary container section 22 increases the pressure of a portion (secondary container section 23) of the container compartment 21 that abuts on the weak sealant section 32. The pressure is parted the weak sealant section 32. Consequently, as shown in FIG. 2D, the packaged article 11 becomes the open state, in which the container compartment 21 is in communication with the outside of the packing bag 12. The content C is discharged in a discharge direction PD.

Figure 3A:
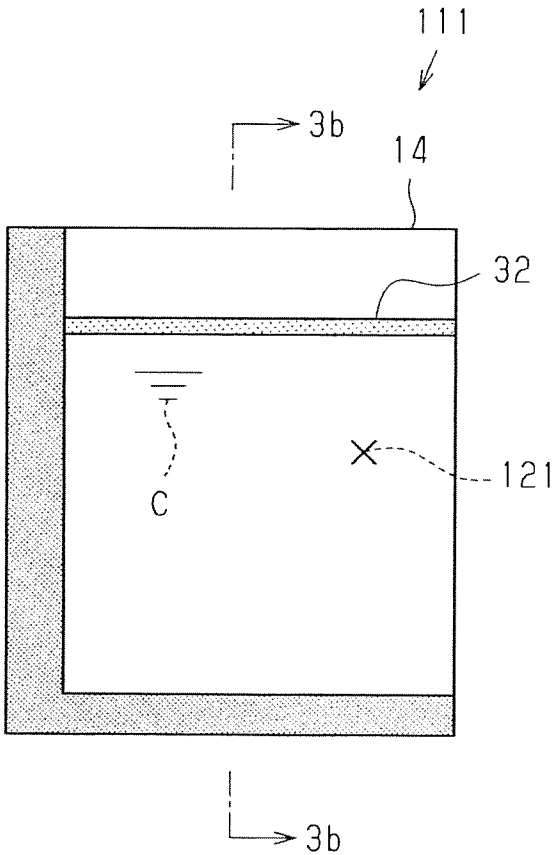
FIG. 3A is a schematic diagram showing a prior art packaged article.
Figure 3B:
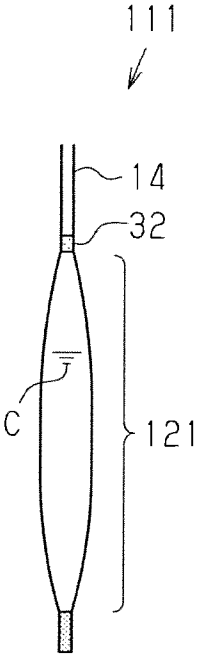
FIG. 3B is a schematic cross-sectional view taken along line 3*b*-3*b* in FIG. 3A.
Figure 3C:
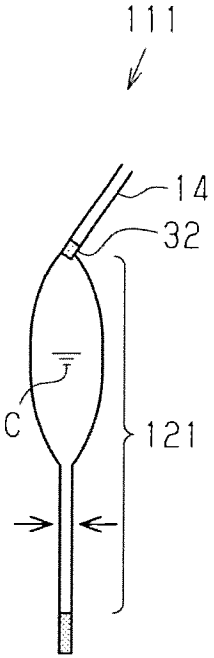
FIG. 3C is a schematic cross-sectional view illustrating a pressing operation performed to open the prior art packaged article.
Figure 3D:
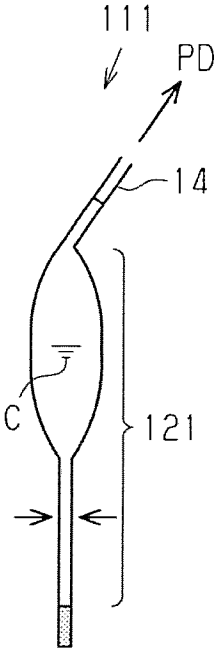
FIG. 3D is a schematic cross-sectional view of the prior art packaged article that is open.

FIGS. 3A and 3B show a prior art packaged article 111 that does not include the secondary container section 23. As shown in FIG. 3C, when a container compartment 121 of the packaged article 111 is pressurized, the boundary portion of the container compartment 121 and the weak sealant section 32 is easily bent. Thus, as shown in FIG. 3D, when the weak sealant section 32 is parted to discharge the content C, the discharge direction PD of the content C tends to be unstable.

In this regard, as shown in FIG. 2D, the packaged article 11 limits the bending of the boundary portion of the container compartment 21 (secondary container section 23) and the weak sealant section 32. This stabilizes the discharge direction PD of the content C. One or both of the first sealant section 33*c* and the second sealant section 33*d* may function as a discharge direction stabilizing means.

The above embodiment has the advantages described below.

(1) The packaged article 11 includes the packing bag 12, which includes the container compartment 21 defined by the welded portion 31 of the base member, and the fluid content C, which is contained in the container compartment 21. The welded portion 31 includes the weak sealant section 32, which is parted when the container compartment 21 is pressed to communicate the container compartment 21 and the exterior of the packing bag 12, and the strong sealant section 33, which maintains the welded state at the time when the weak sealant section 32 is parted. The container compartment 21 includes the primary container section 22 and the secondary container section 23. The secondary container section 23 includes the narrow neck, which is narrower than the primary container section 22 in the width-wise direction Y, which corresponds to the direction in which the weak sealant section 32 extends. The secondary container section 23 is in communication with the primary container section 22 at the narrow neck. The secondary container section 23 is located adjacent to the weak sealant section 32.

This structure limits the bending of the boundary portion of the container compartment 21 (secondary container section 23) and the weak sealant section 32 when the primary container section 22 is pressed. Thus, when the packaged article 11 is opened by pressing the container compartment 21, the discharge direction PD of the content C is stabilized. This allows for smooth discharging of the content C into a vessel.

(2) In the packaged article 11, it is preferred that the minimum width S1 of the narrow neck of the secondary container section 23 be in the range of 30% or greater and 90% or less when the maximum width M1 of the primary container section 22 is set as 100%. When the minimum width S1 of the secondary container section 23 is 30% or greater, the discharging speed of the content C is easily ensured. When the minimum width S1 of the secondary container section 23 is 90% or less, the bending of the boundary portion of the container compartment 21 and the weak sealant section 32 is further easily limited. Therefore, when the packaged article 11 is opened by pressing the primary container section 22, the discharge direction PD of the content C is stabilized.

(3) In the packaged article 11, it is preferred that the secondary container section 23 include one of the first secondary container section, which is formed by the narrow neck having the fixed width, and the second secondary container section, which includes a portion that is wider than the minimum width of the narrow neck and located between the part of the narrow neck having the minimum width and the weak sealant section 32. In this case, when the packaged article 11 is opened by pressing the container compartment 21, the discharge direction PD of the content C is stabilized.

(4) In the packaged article 11, it is preferred that the narrow neck of the secondary container section 23 has a shape narrowed from opposite sides of the primary container section 22 in the width-wise direction Y. In this case, the operation that limits the bending of the boundary portion of the container compartment 21 and the weak sealant section 32 is well-balanced in the width-wise direction Y. Therefore, when the packaged article 11 is opened by pressing the container compartment 21, the discharge direction PD of the content C is stabilized.

(5) In the packaged article 11, it is preferred that the narrow neck of the secondary container section 23 be symmetrical with respect to the imaginary plane that is orthogonal to the width-wise direction Y. In this case, the operation that limits the bending of the boundary portion of the container compartment 21 and the weak sealant section 32 is well-balanced in the width-wise direction Y.

(6) In the packaged article 11, it is preferred that the maximum height S2 of the secondary container section 23 be in the range of 2.5% or greater and 35% or less when the maximum height M2 of the container compartment 21 is set as 100%. When the maximum height S2 of the secondary container section 23 is 2.5% or greater, the operation that limits the bending of the boundary portion of the container compartment 21 and the weak sealant section 32 is further easily obtained. When the maximum height S2 of the secondary container section 23 is 35% or less, the capacity of the primary container section 22 is easily ensured.

(7) In the packaged article 11, it is preferred that the edge of the strong sealant section 33 forming the narrow neck of the secondary container section 23 satisfy at least one of condition A, condition B, and condition C, which are described above. In this case, the bending of the boundary portion of the container compartment 21 and the weak sealant section 32 is further easily limited. Therefore, when the packaged article 11 is opened by pressing the container compartment 21, the discharge direction PD of the content C is stabilized.

(8) A packing bag obtained by folding a resin film that has a uniform thickness or a packing bag obtained by adhering resin films that have the same level of thickness to each other has the advantage of superior productivity among packing bags of packaged articles. However, such packing bags of packaged articles are relatively soft. Thus, the boundary portion of the container compartment and the weak sealant section particularly has a tendency to easily bend. Therefore, it is particularly advantageous to apply the packaged article 11 having the above structure to a packaged article that includes a packing bag formed from a resin film.

Additionally, when a packing bag formed from a resin film has relatively small dimensions (small bag), an efficient opening method is to part the weak sealant section by pressing (compressing) the small bag with the container compartment held, for example, between the thumb and the index finger. However, a weak sealant section side of the boundary portion of the container compartment and the weak sealant section may be inclined to the thumb side or the index finger side depending on how the force is applied to the container compartment. Thus, the unstable discharge direction of the content particularly easily complicates the operation for discharging the content into a vessel. Therefore, it is particularly advantageous to apply the packaged article 11 having the above structure to a packaged article that includes a packing bag having relatively small dimensions.

As described above, the packaged article 11 including the secondary container section 23 is particularly advantageous when the packing bag 12 is formed from a resin film and has relatively small dimensions (small bag).

(9) When the packing bag 12 includes the inlet 14, the scattering of the content C is limited in the thickness-wise direction of the base member, for example, immediately after the parting of the weak sealant section 32. However, the bending of the boundary portion of the container compartment and the weak sealant section 32 would result in relatively large movement of the opening 14*b* of the inlet 14. In this regard, the packaged article 11 of the present embodiment limits the bending of the boundary portion of the container compartment 21 and the weak sealant section 32. This restricts the movement of the opening 14*b* of the inlet 14. Therefore, while the scattering of the content C is limited in the thickness-wise direction of the base member immediately after the parting of the weak sealant section 32, the discharge direction PD of the content C is stabilized.

(10) It is preferred that the weak sealant section 32 be formed so that the anti-bag breakage strength of the packaged article 11 is in the range of 1 kgf or greater and 4 kgf or less. It is further preferred that the anti-bag breakage strength be 2 kgf or greater and 3 kgf or less. Such setting of the anti-bag breakage strength further limits the bending of the boundary portion of the container compartment 21 (secondary container section 23) and the weak sealant section 32 when the primary container section 22 is pressed. For example, even when the anti-bag breakage strength is set to 2 kgf or greater and 3 kgf or less, the packaged article 11 may be externally packed from an outer case or a tray. This limits the bag breakage of the packaged article 11 when the packaged article 11 is transported or dropped.

MODIFIED EXAMPLES

The above embodiment may be modified as follows. Further, modified examples may be combined.

Figure 4A:
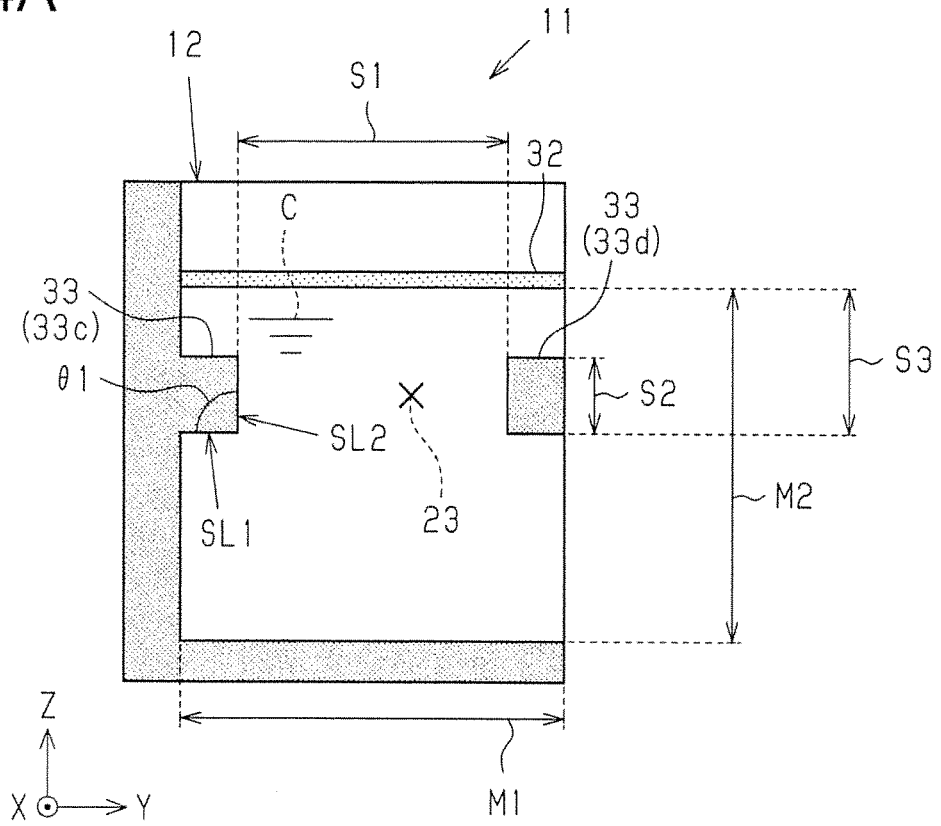
FIGS. 4A and 4B are schematic front views showing modified examples of a packaged article.

As shown in FIG. 4A, the secondary container section 23 may be spaced apart from the weak sealant section 32. The weak sealant section 32 is separated from the end of the secondary container section 23 (primary container section 22) by a distance S3, which is, preferably, 30% of the maximum height M2 of the container compartment 21 or less, and more preferably, 15% or less.

Figure 4B:
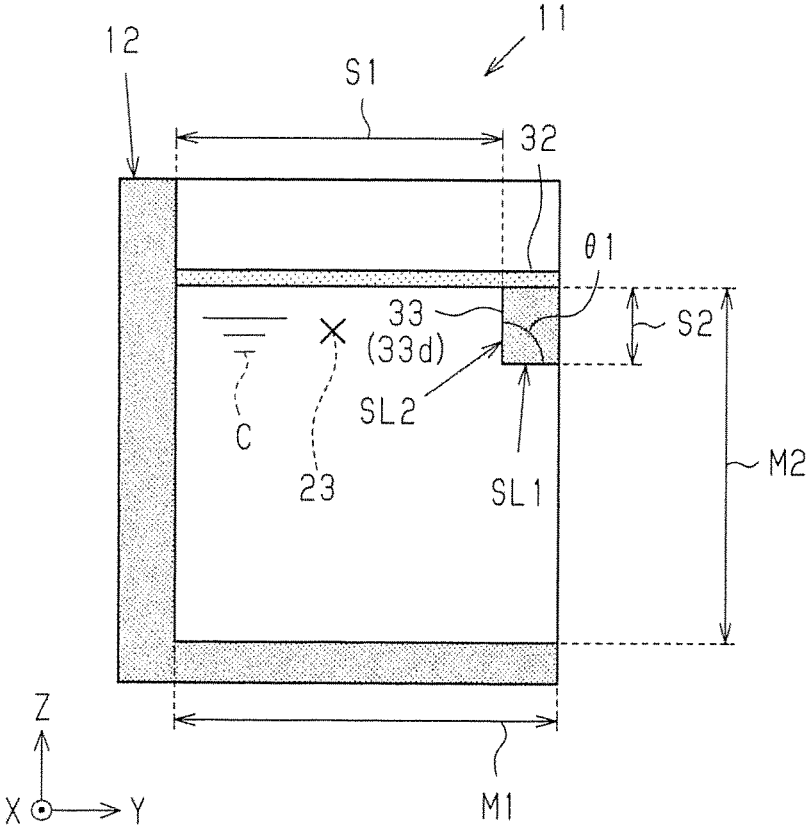

As shown in FIG. 4B, the first sealant section 33*c* may be omitted from the secondary container section 23. For example, the secondary container section 23 may be formed by one of the first sealant section 33*c* and the second sealant section 33*d*.

Figure 5:
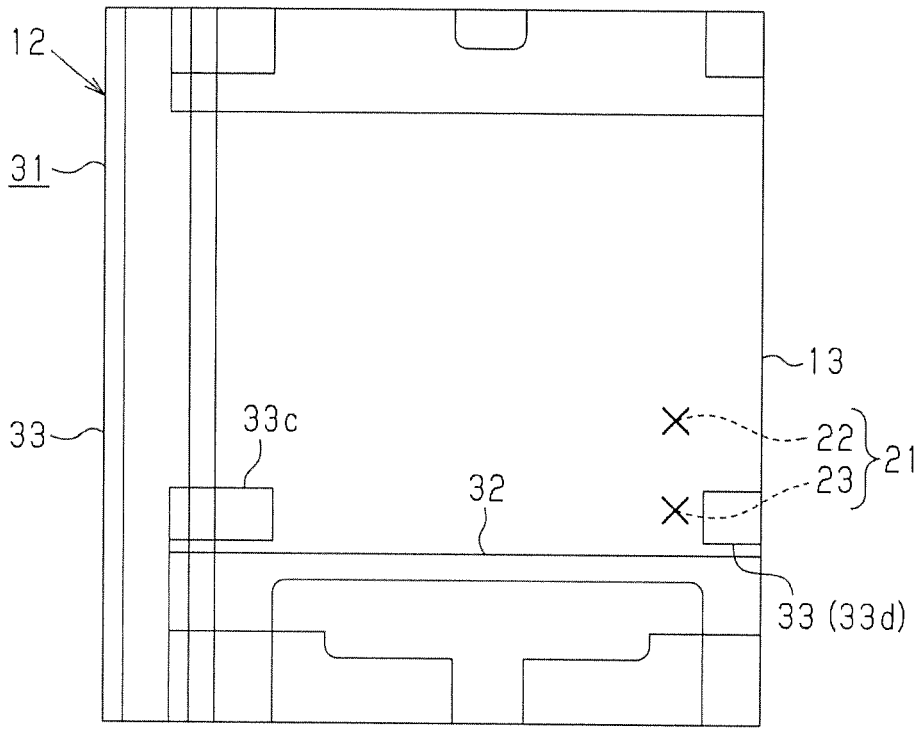
FIG. 5 is a front view showing a modified example of a packing bag.
Figure 6:
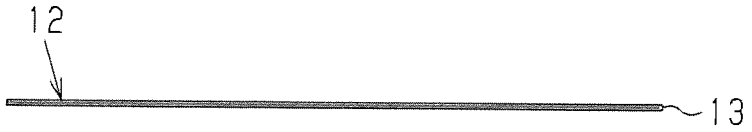
FIG. 6 is an elevated view showing the packing bag of FIG. 5.
Figure 7A:
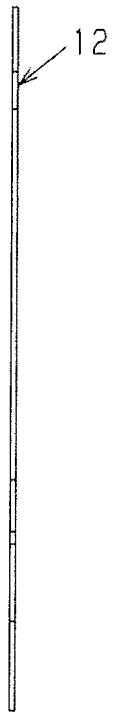
FIG. 7A is a right side view showing the packing bag of FIG. 5.
Figure 7B:
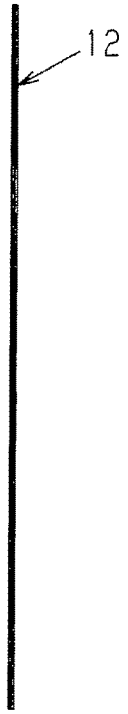
FIG. 7B is a left side view showing the packing bag of FIG. 5.
Figure 8:
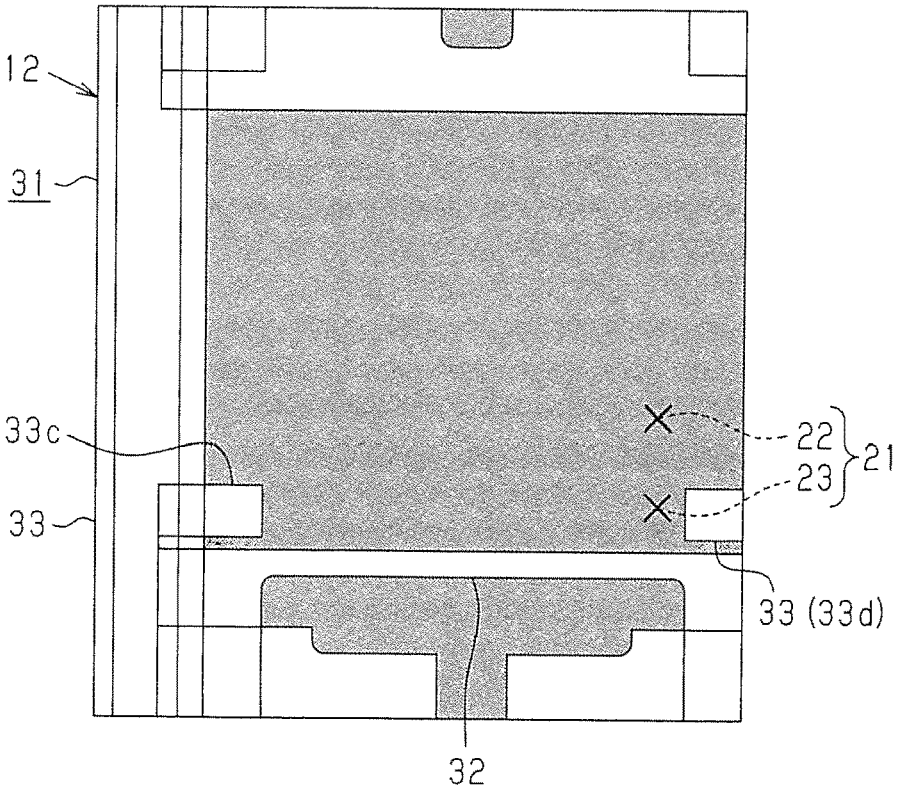
FIG. 8 is a schematic diagram showing a non-welded region of the packing bag of FIG. 5.
Figure 9:
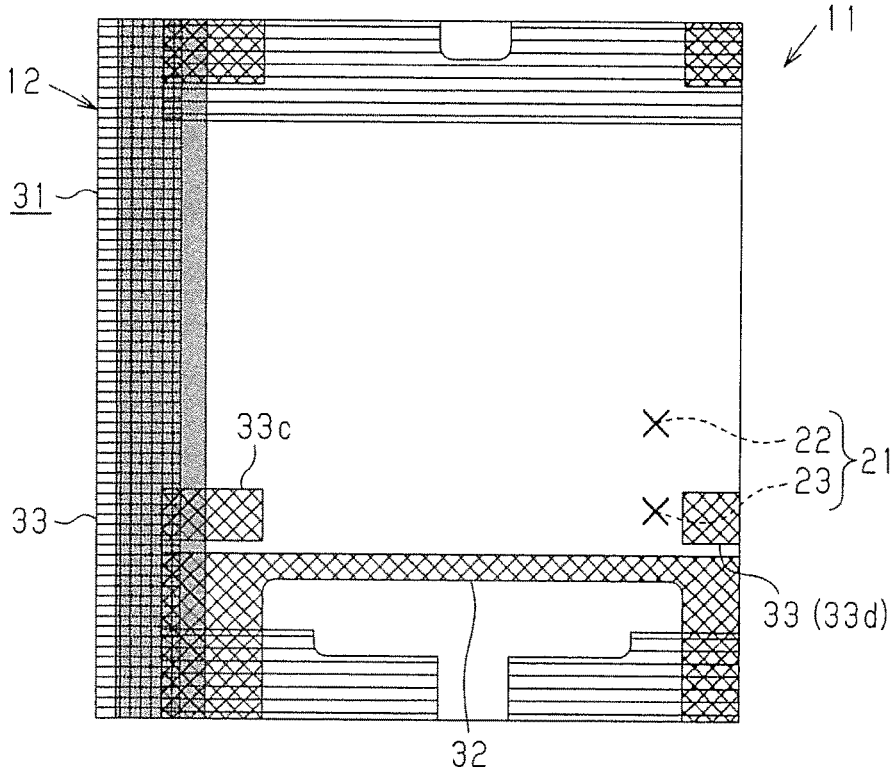
FIG. 9 is a schematic diagram showing an application of the packing bag (packaged article) of FIG. 5.
Figure 10:
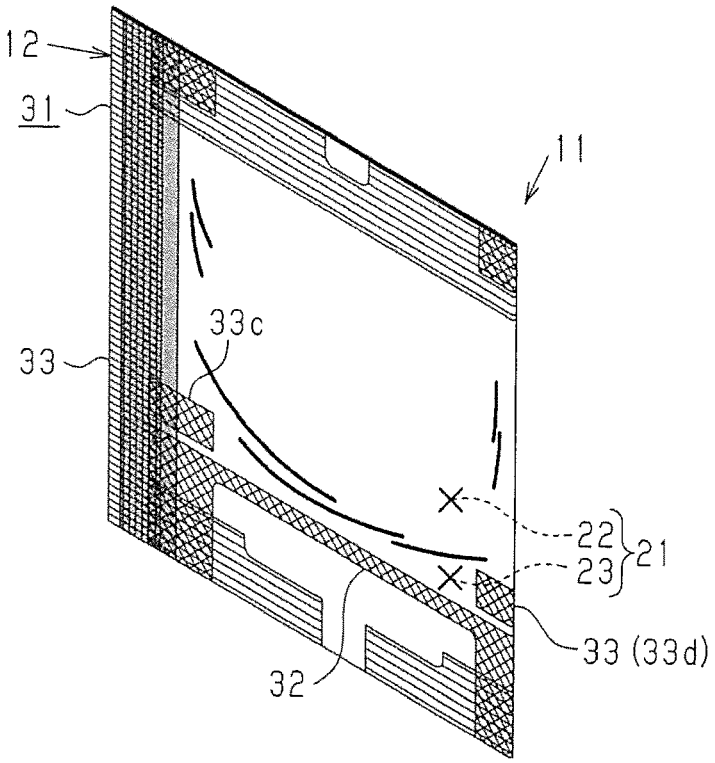
FIG. 10 is a schematic diagram showing an application of the packing bag (packaged article) of FIG. 5.

The shape of the packing bag 12 may be changed as shown in FIGS. 5 to 10. The rear view of this modified example is symmetrical to the front view that is shown in FIG. 5. The bottom view of this modified example is the same as the elevated view that is shown in FIG. 6. The screentone of FIG. 8 shows the non-welded region.

Figure 11:
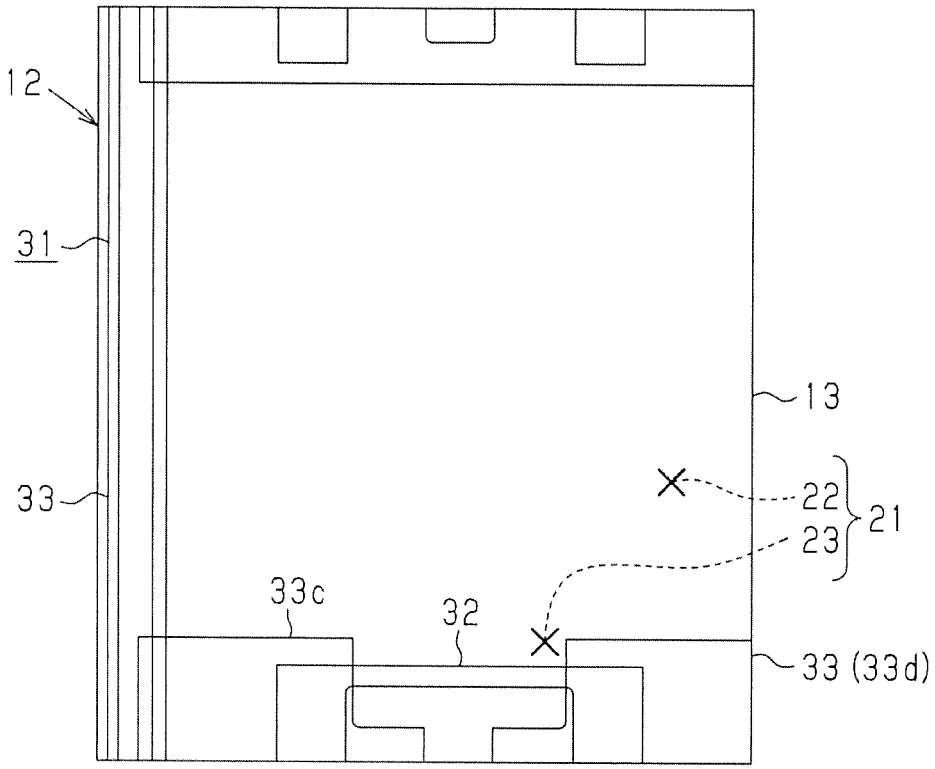
FIG. 11 is a front view showing a modified example of a packing bag.
Figure 12:
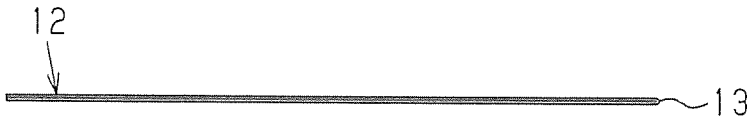
FIG. 12 is an elevated view showing the packing bag of FIG. 11.
Figure 13A:
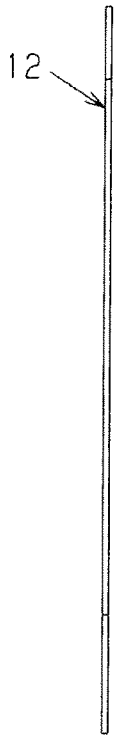
FIG. 13A is a right side view showing the packing bag of FIG. 11.
Figure 13B:
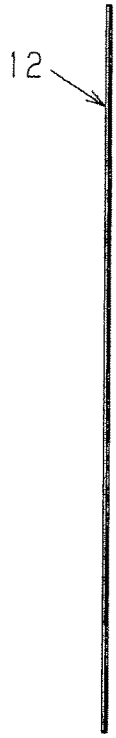
FIG. 13B is a left side view showing the packing bag of FIG. 11.
Figure 14:
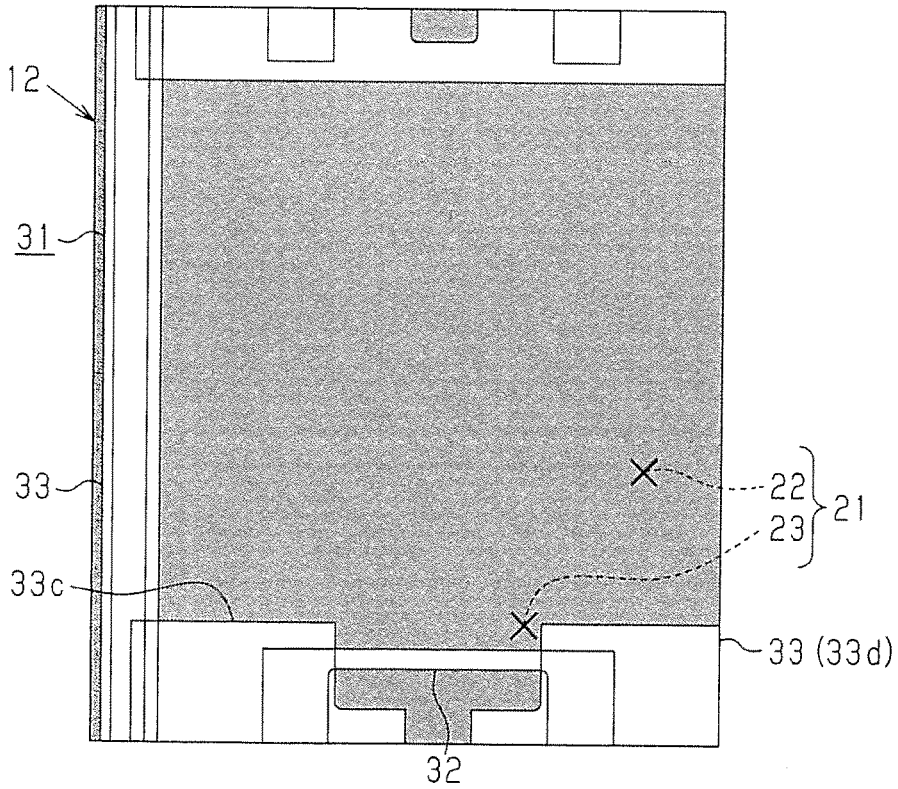
FIG. 14 is a schematic diagram showing an application of the packing bag (packaged article) of FIG. 11.
Figure 15:
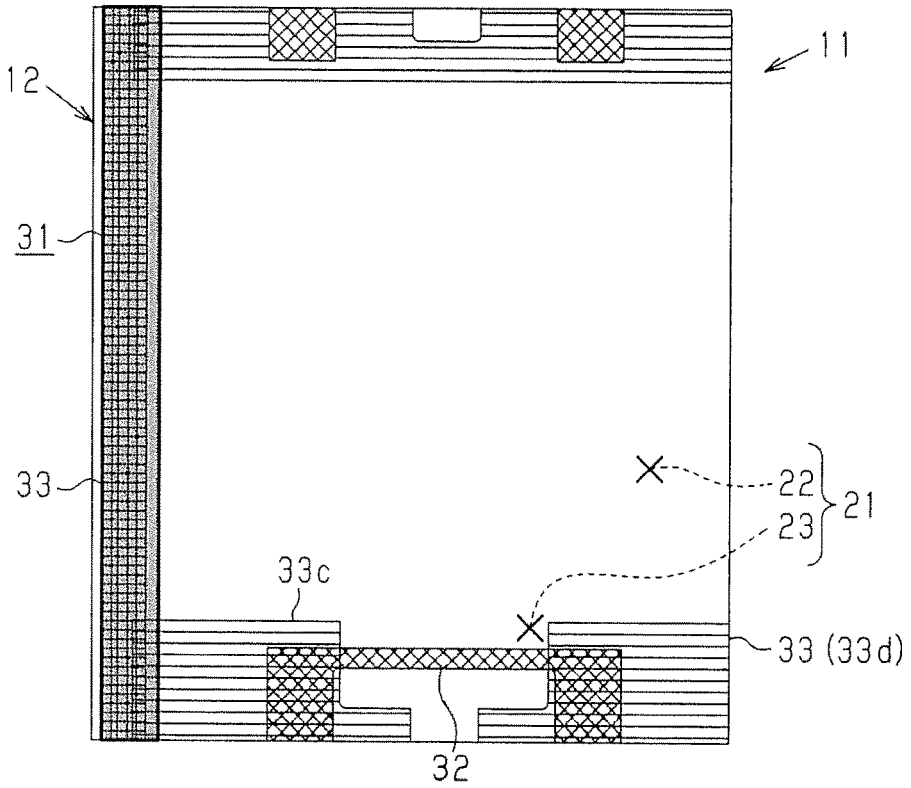
FIG. 15 is a schematic diagram showing an application of the packing bag (packaged article) of FIG. 11.
Figure 16:
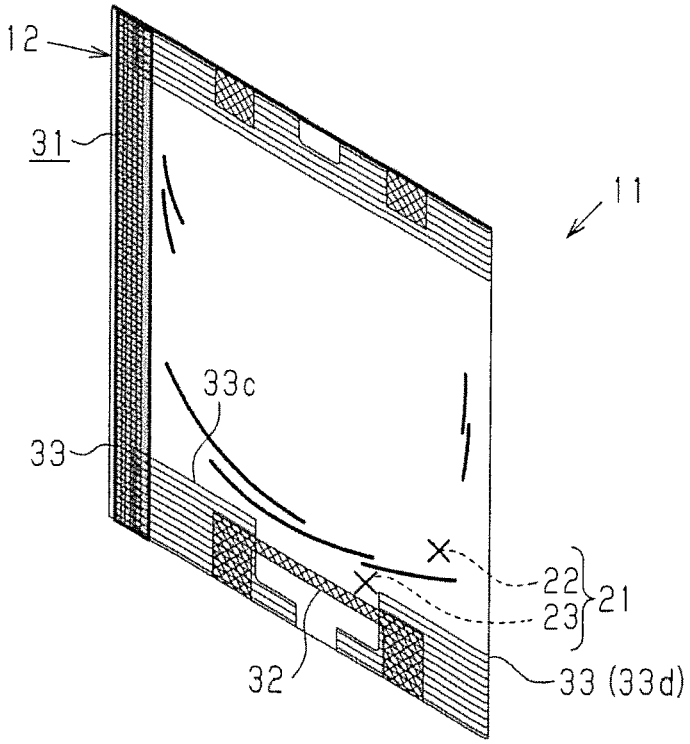
FIG. 16 is a schematic diagram showing a usage state (packaged article) of the packing bag of FIG. 11.

The shape of the packing bag 12 may be changed as shown in FIGS. 11 to 16. The rear view of this modified example is symmetrical to the front view that is shown in FIG. 11. The bottom view of this modified example is the same as the elevated view that is shown in FIG. 12. The screentone of FIG. 14 shows the non-welded region.

Figure 17:
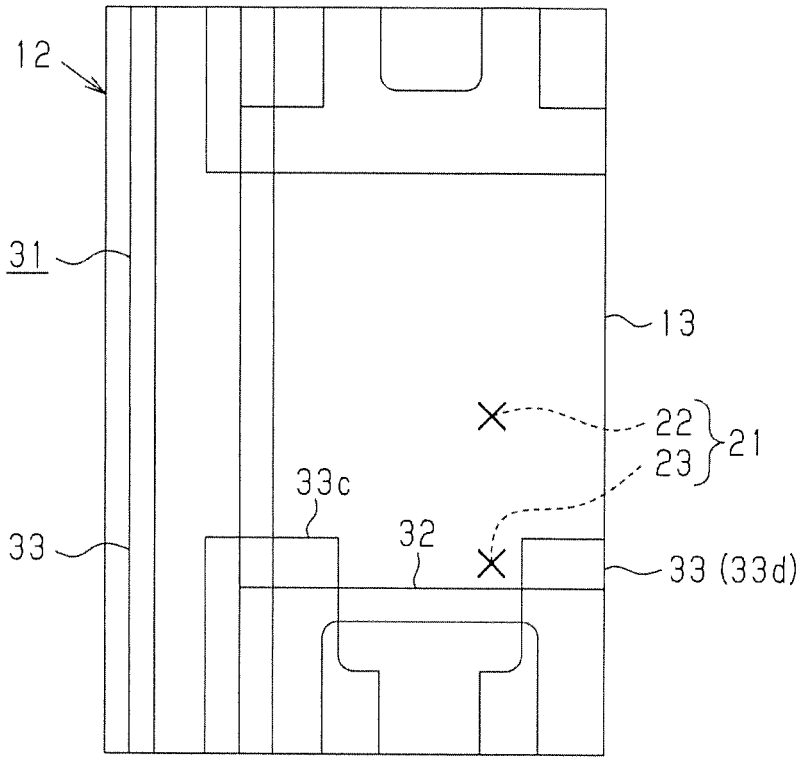
FIG. 17 is a front view showing a modified example of a packing bag.
Figure 18:
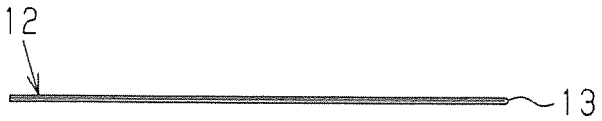
FIG. 18 is an elevated view showing the packing bag of FIG. 17.
Figure 19A:
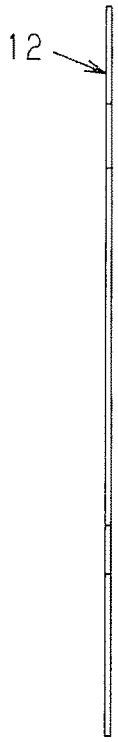
FIG. 19A is a right side view showing the packing bag of FIG. 17.
Figure 19B:
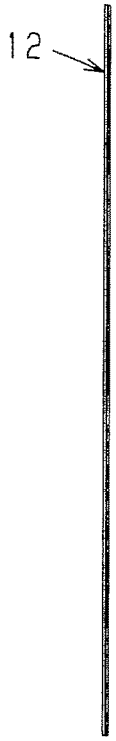
FIG. 19B is a left side view showing the packing bag of FIG. 17.
Figure 20:
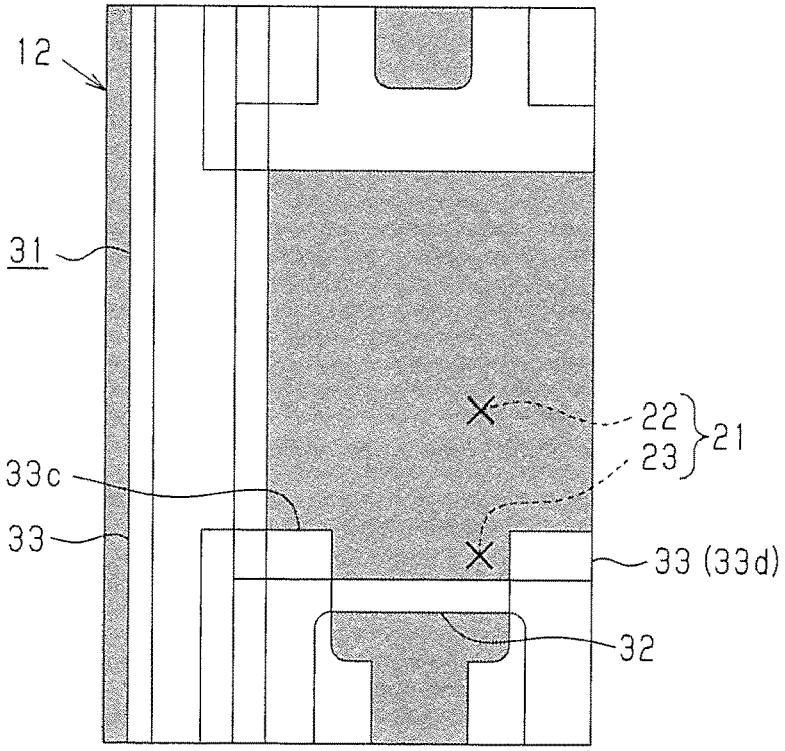
FIG. 20 is a schematic diagram showing a non-welded region of the packing bag of FIG. 17.
Figure 21:
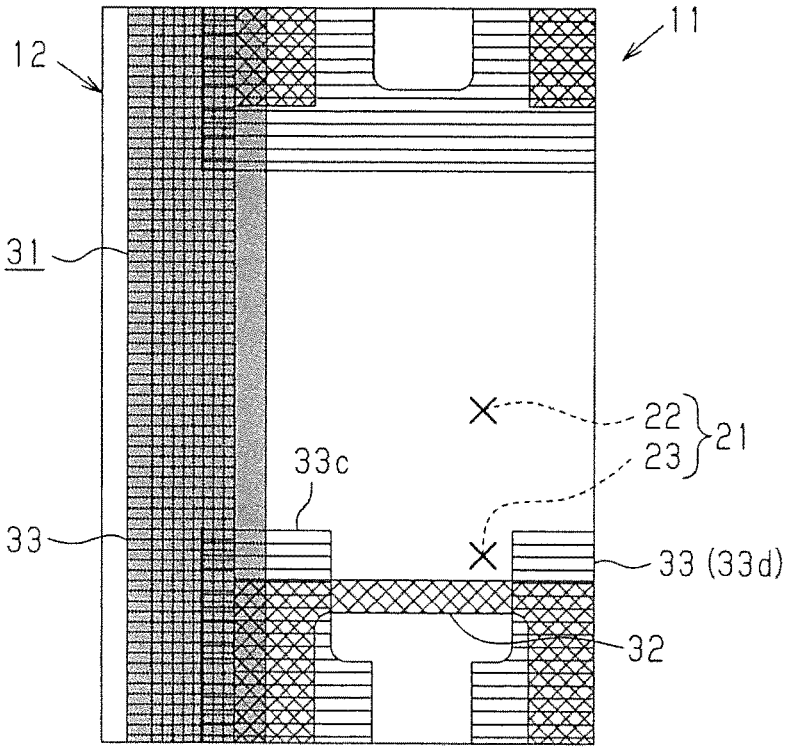
FIG. 21 is a schematic diagram showing an application of the packing bag (packaged article) of FIG. 17.
Figure 22:
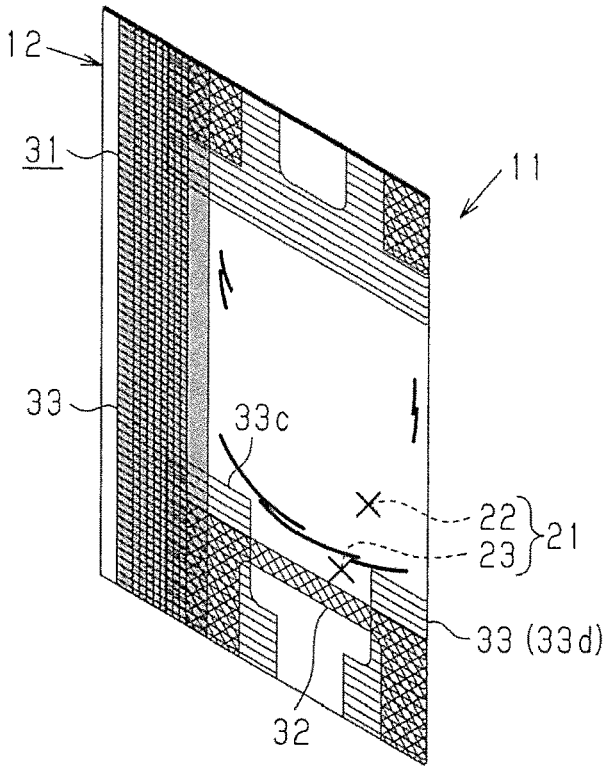
FIG. 22 is a schematic diagram showing an application of the packing bag (packaged article) of FIG. 17.

The shape of the packing bag 12 may be changed as shown in FIGS. 17 to 22. The rear view of this modified example is symmetrical to the front view that is shown in FIG. 17. The bottom view of this modified example is the same as the elevated view that is shown in FIG. 18. The screentone of FIG. 20 shows the now-welded region.

Figure 23:
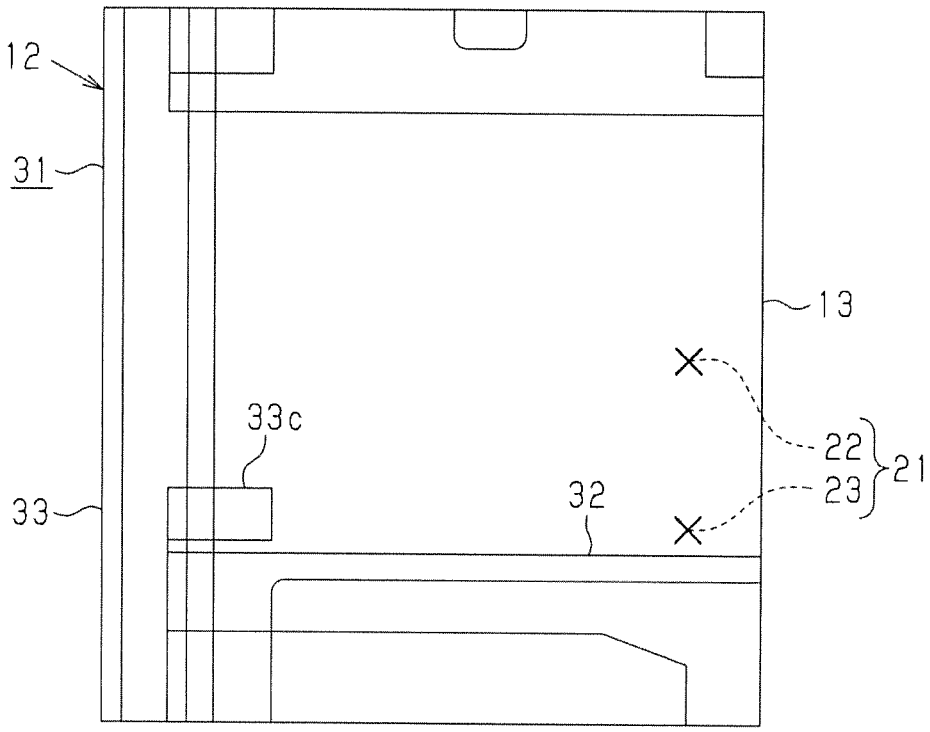
FIG. 23 is a front view showing a modified example of a packing bag.
Figure 24:
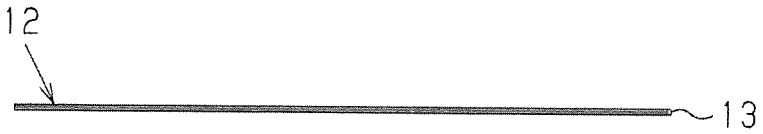
FIG. 24 is an elevated view showing the packing bag of FIG. 23.
Figure 25A:
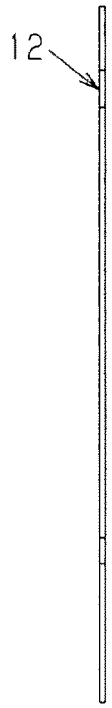
FIG. 25A is a right side view showing the packing bag of FIG. 23.
Figure 25B:
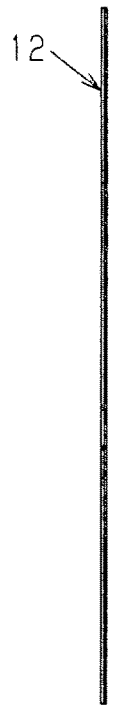
FIG. 25B is a left side view showing the packing bag of FIG. 23.
Figure 26:
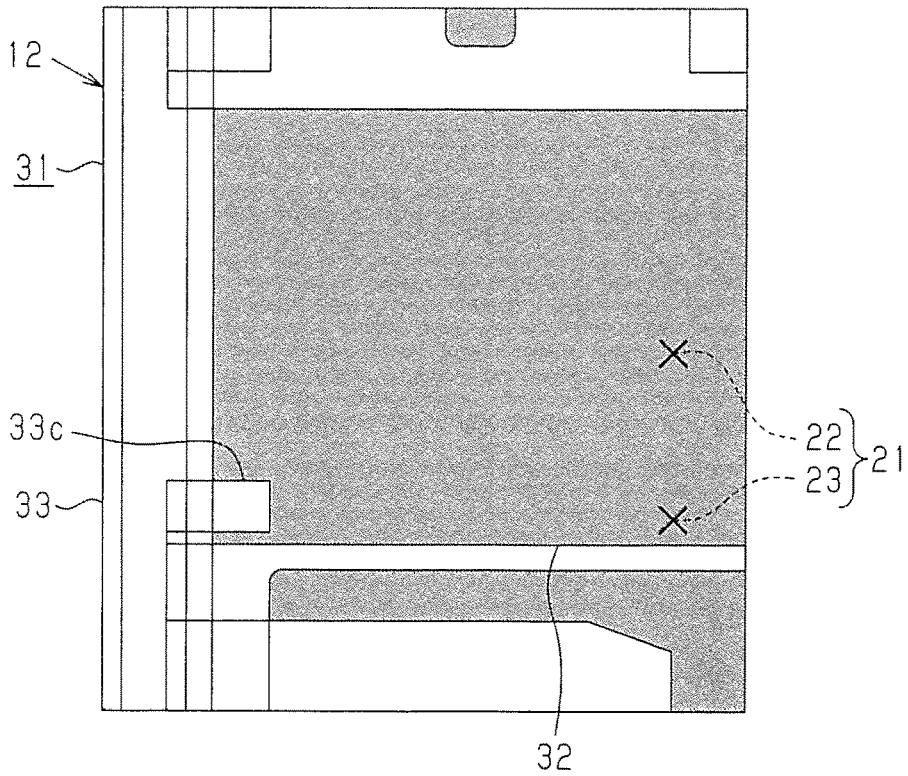
FIG. 26 is a schematic diagram showing a non-welded region of the packing bag of FIG. 23.
Figure 27:
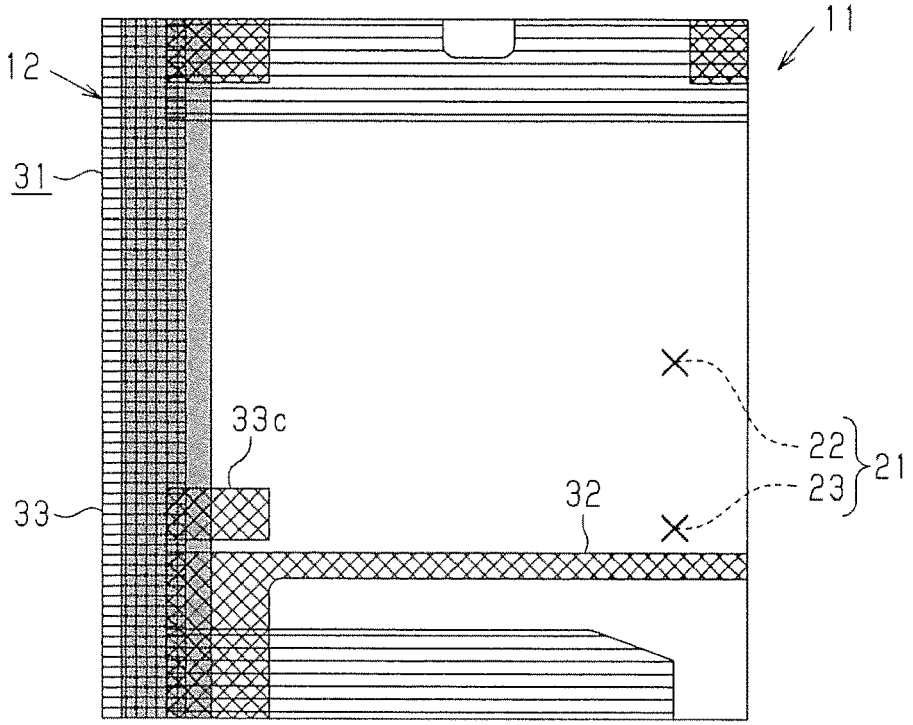
FIG. 27 is a schematic diagram showing an application of the packing bag (packaged article) of FIG. 23.
Figure 28:
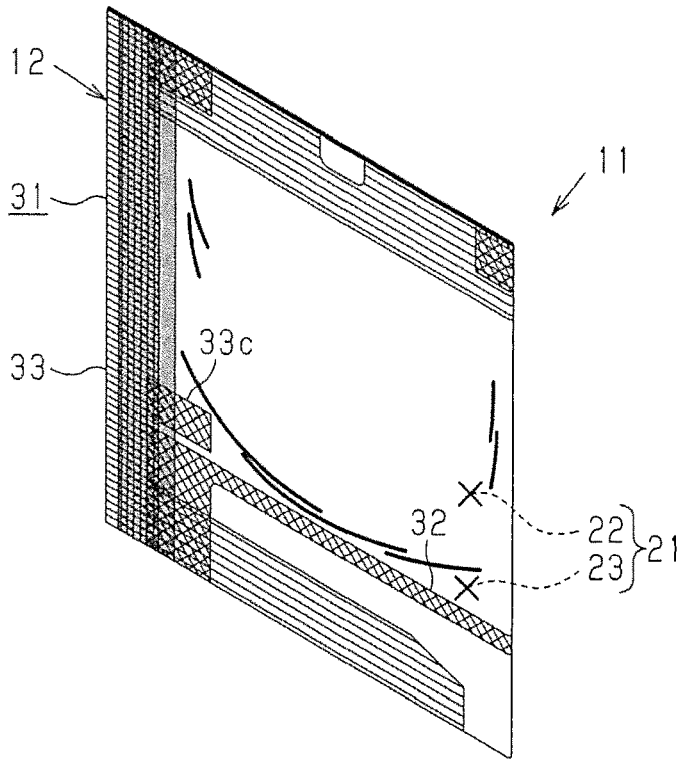
FIG. 28 is a schematic diagram showing an application of the packing bag (packaged article) of FIG. 23.

The shape of the packing bag 12 may be changed as shown in FIGS. 23 to 28. The rear view of this modified example is symmetrical to the front view that is shown in FIG. 23. The bottom view of this modified example is the same as the elevated view that is shown in FIG. 24. The screentone of FIG. 26 shows the non-welded region.

The narrow neck of the secondary container section 23 may be formed when one of the first sealant section 33*c* and the second sealant section 33*d* is spaced apart from the weak sealant section 32.

In the embodiment and some of the modified examples, the discharge direction PD of the content C corresponds to the height-wise direction Z, which is orthogonal to the extension direction of the weak sealant section 32. However, the discharge direction PD may be changed to any predetermined direction. For example, the discharge direction PD may correspond to a direction that is non-orthogonal to the extension direction of the weak sealant section 32 such as a direction inclined from the extension direction of the weak sealant section 32.

The narrow neck of the secondary container section 23 may include a plurality of narrow necks that are spaced apart from each other in a direction that is intersected with or orthogonal to the extension direction of the weak sealant section 32, for example, the height-wise direction Z.

In the illustrated example, the packing bag 12 is rectangular in a plan view. However, as described above, the packing bag 12 may have any desired shape. For example, when the shape of the packing bag 12 is a polygon such as a parallelogram or a rhombus in a plan view, the description of the geometry of the packing bag 12 may be read with the XYZ axes, which are shown in, for example, FIG. 1A, replaced with the oblique coordinate system. When the packing bag 12 is non-polygonal, the description of the geometry of the packing bag 12 may be read, for example, with the extension direction of the weak sealant section 32 used as the frame of reference.

The shape of the flow passage 14*a* of the inlet 14 may be changed to, for example, a shape that narrows toward the opening 14*b* in a continuous or stepped manner.

The inlet 14 may be omitted from the packing bag 12. For example, the weak sealant section 32 may be formed along the outer edge of the packing bag 12.

Another strong sealant section may be provided to seal the opening 14*b* of the inlet 14. For example, the opening 14*b* of the inlet 14 may be formed by removing the strong sealant section when the packaged article is used.

The inlet 14 may be changed to a strong sealant section. In this case, when the packaged article is used, the strong sealant section is removed. Then, the packing bag 12 may be opened by parting the weak sealant section 32.

Figure 29:
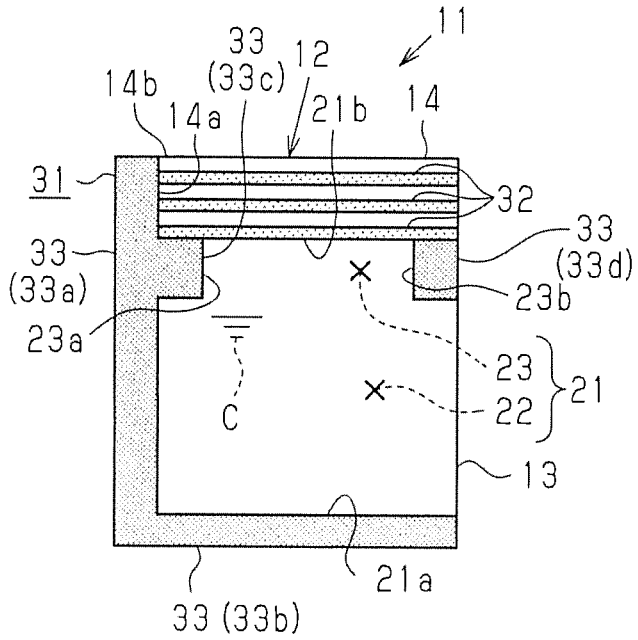
FIG. 29 is a front view showing a modified example of a packing bag.
Figure 30:
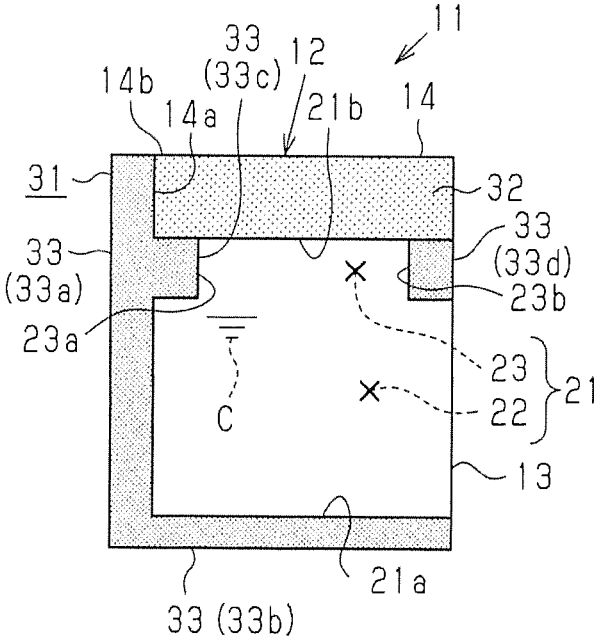
FIG. 30 is a front view showing a modified example of a packing bag.

The dimensions of the weak sealant section 32 and the number of weak sealant sections 32 may be changed. For example, as shown in FIG. 29, a plurality of weak sealant sections 32 may be spaced apart from each other in the discharge direction PD of the content C. The packing bag 12 may be opened by sequentially parting the weak sealant sections 32 of multiple steps. As shown in FIG. 30, the entire inlet 14 (flow passage 14*a*) may be welded by the weak sealant section 32.

For example, when the weak sealant section 32 of the embodiment is changed to a strong sealant section, the longitudinal sealant section 33*a* or the lateral sealant section 33*b* of the embodiment may be changed to a weak sealant section. For example, when a portion of the longitudinal sealant section 33*a* is changed to a weak sealant section, the first inner edge (inner edge opposed to weak sealant section) of the container compartment is formed by a folded side instead of the strong sealant section. Even when the position of the weak sealant section is changed as described above, it is advantageous to arrange the secondary container section at a position close to the weak sealant section as described in advantage (1).

The packing bag 12 of the embodiment is a three-side sealed packing bag. However, the packing bag 12 may be changed to, for example, a four-side sealed packing bag or a pillow-type packing bag. Regardless of the type of the packing bag 12, it is preferred that the packing bag 12 be a flexible bag that includes the first panel 12*a* and the second panel 12*b*, which is overlapped with the first panel 12*a*. The first and second panels 12*a*, 12*b* may have substantially the same width, the same area, and the same shape. The base member may be a single flexible film. However, the base member may be a plurality of flexible films. Alternatively, the base member may be a single flexible tube. When the base member is a single flexible film that is folded at the folded side 13, a portion of the base member functions as the first panel 12*a*. Another portion of the base member functions as the second panel 12*b*, which is overlapped with the first panel 12*a*. When the base member is a plurality of flexible films, which is, for example, two flexible films, a first flexible film may function as the first panel 12*a* while a second flexible film functions as the second panel 12*b*. In this case, the folded side 13 may be replaced by a longitudinal sealant that is similar to the longitudinal sealant section 33*a*. When the base member is a flexible tube, the longitudinal sealant section 33*a* may be replaced by a folded side that is similar to the folded side 13.

EXAMPLES

The tests that verify the effects of the featured structures will now be described.

In the description, test 1 verifies the effectiveness of the secondary container section 23 that includes the narrow neck. Tests 2 to 7 verify preferred structures. Test 8 compares a prior art product.

In the tests described below, a tetragonal packing bag having a dimension (dimension extending along diagonal line) of approximately 750 mm was produced. A lamination film having a thickness of appropriately 42 μm was used as the base member of the packing bag. The content of the packaged article was a liquid condiment added to natto.

Test 1

Test 1 determined the preferred range of the minimum width S1 (minimum width S1/maximum width M1: refer to, for example, FIG. 1B) of the narrow neck of the secondary container section 23.

In test 1, based on the shape shown in FIG. 1B, the maximum width M1 was set to 35 mm, the maximum height M2 was set to 40 mm, the maximum height S2 was set to 5 mm, the distance S3 was set to 5 mm, and the first angle θ1 was set to 90°. In this setting, the minimum width S1 was changed to 11 mm, 23 mm, 27 mm, and 31 mm by four steps. The result of test 1 shows that when the primary container section 22 was pressed, the bending was limited and the content C was smoothly discharged in any range of the minimum width S1 from 11 to 31 mm. This effect was more improved when the minimum width S1 was in the range of 23 to 31 mm and further improved when the minimum width S1 was 27 mm and 31 mm.

The above description verifies that it is preferred that the minimum width S1 of the narrow neck of the secondary container section 23 be in the range described above when the maximum width M1 of the primary container section 22 is set as 100%.

Test 2

Test 2 determined the preferred range of the maximum height S2 (maximum height S2/maximum height M2: refer to, for example, FIG. 1B, distance S3/maximum height M2: refer to, for example, FIG. 4A) of the secondary container section 23.

In test 2, the values were set in the same manner as test 1 except for the minimum width S1, the maximum height S2, and the distance S3. The minimum width S1 was set to 27 mm, which was in the range of 23 to 31 mm that obtained the superior results in test 1. Under this condition, test 2-1 and test 2-2 were conducted as described below.

In test 2-1, the maximum height S2 and the distance S3 were changed to 1 mm, 2 mm, 3 mm, 4 mm, 5 mm, 6 mm, and 14 mm at seven steps so that the maximum height S2 and the distance S3 had the same value.

In test 2-2, the distance S3 was set to 6 mm. The maximum height S2 was set to 1 mm, 2 mm, 3 mm, 4 mm, and 5 mm at five steps.

The result of test 2-1 shows that when the primary container section 22 was pressed, the bending was limited and the content C was smoothly discharged in any range of the maximum height S2 and the distance S3 from 1 to 14 mm. This effect was more improved when the maximum height S2 and the distance S3 were in the range of 2 to 6 mm and further improved in the range of 2 to 5 mm. The result also shows that the effect for limiting the bending had a tendency to be improved as the maximum height S2 and the distance S3 were increased. The increases in the maximum height S2 and the distance S3 improve the effect for limiting the bending. However, it was also verified that an excessive increase in the maximum height S2 and the distance S3 decreased the size of the primary container section 22, which was to be pressed, and tended to adversely affect the opening operation.

The above description verifies that it is preferred that the maximum height S2 be in the range described above when the maximum height M2 of the container compartment 21 is set as 100%.

The result of test 2-2 shows that even when the maximum height S2 and the distance S3 were set so that the maximum height S2 was less than the distance S3, the bending was limited and the content C was smoothly discharged when the primary container section 22 was pressed.

Additionally, when the narrow neck was narrowed from opposite sides of the primary container section in the width-wise direction within a range in which the effectiveness was verified in test 1 and test 2, the torsion of the packing bag 12 was limited when the primary container section 22 was pressed and the discharging of the content C was further stabilized. Furthermore, when the narrow neck was symmetrical with respect to an imaginary plane that is orthogonal to the width-wise direction Y of the primary container section, the torsion of the packing bag 12 was further limited when the primary container section 22 was pressed and the discharging of the content C was further stabilized.

Test 3

Test 3 determined the preferred range of the first angle θ1 used in condition A based on the range in which the effectiveness was verified in test 1 and test 2.

As shown in table 1, the shape shown in FIG. 4A was used as the base shape of tests 3-1 to 3-7. The packaged articles produced in each test were evaluated using the evaluation process described below.

Evaluation Process

The sampler performed the opening operation by pressing the packaged articles of test 3-1 to 3-7 with the primary container section held between the index finger and the thumb and measured the bending angle. The bending angle is obtained when the container compartment of each packaged article is pressed and the bent state is viewed from the side of the packaged article immediately before the weak sealant section is parted. In each test, the bending angle was measured when the opening operation was performed on each of ten packaged articles, and the average value was calculated. The packaged articles of each test were evaluated from the calculated average value using the reference described below.

Bending angle is less than 30°: 4

Bending angle is 30° or greater and less than 60°: 3

Bending angle is 60° or greater and less than 90°: 2

Bending angle is 90° or greater: 1

As shown in table 1, the evaluation results of tests 3-1 to 3-7 verified that the evaluation result was 2 points or greater when the first angle θ1 of condition A was in the range of 30 to 170°, which was the effective range. When the first angle θ1 was 60 to 120°, the evaluation result was 3 points or greater. When the first angle θ1 was in the range of 80 to 100°, that is, substantially orthogonal, the evaluation result was 4 points.

Test 4

Test 4 determined the preferred range of the second angle θ2 used in condition B based on the range in which the effectiveness was verified in test 1 and test 2.

As shown in table 1, the shape shown in FIG. 1C was used as the base shape of tests 4-1 to 4-5. The packaged articles produced in each test were evaluated in the same manner as test 3.

As shown in table 1, the evaluation result was 3 points or greater in any of tests 4-1 to 4-5. This verifies that the superior effect was produced. Particularly, as the value of the second angle θ2 was decreased, the tendency to improve the effect was verified.

Test 5

As shown in table 1, test 5 determined the preferred range of the third angle θ3 used in condition C based on the shape shown in FIG. 1D.

As shown in FIG. 1D, the first sealant section 33*c* is a polygon having a rounded corner. The first straight portion SL1 and the second straight portion SL2 are connected by an arc. The length of each of the first straight portion SL1 and the second straight portion SL2 is 2 mm. The radius of the arc is 1 mm. In the polygon having the rounded corner, a tangent line TL3 at any point of the arc intersects with an extension line of the third straight portion SL3 at the third angle θ3. The minimum third angle θ3 is formed by the extension line of the third straight portion SL3 shown in FIG. 1D and the tangent line TL3 located on the point where the first straight portion SL1 is connected to the arc. An infinite number of intersections of the extension line and the tangent line exists. The minimum third angle is substantially 0°. The packaged articles produced in test 5 were evaluated in the same manner as test 3. The evaluation result was 4 points. This shows that the above shape was also effective.

Test 6 and Test 7

As shown in table 1, the shape shown in FIG. 17 was used as the base shape of test 6. The shape shown in FIG. 11 was used as the base shape of test 7. The packaged articles produced in test 6 and test 7 were evaluated in the same manner as test 3. The evaluation results were 4 points. This shows that the above shapes were also effective.

It was verified that the same effects of test 1 to 7 were obtained in other shapes in addition to the shapes shown in FIGS. 1A to 1D.

Test 8

As shown in table 1, test 8 is the comparative subject based on the shape shown in FIG. 3A. Prior art packaged articles produced in test 8 were evaluated in the same manner as test 3. The evaluation result was 1 point.

TABLE 1

| | Drawing | M1 [mm] | S1 [mm] | S1/M1 × 100 [%] | M2 [mm] | S2 [mm] | S2/M2 × 100 [%] | S3 [mm] | S3/M2 × 100 [%] | θ1 | θ2 | θ3 | Evaluation Result |
|---|---|---|---|---|---|---|---|---|---|---|---|---|---|
| Test 3-1 | FIG. 4A | 35 | 27 | 77.1 | 40 | 4 | 10 | 5 | 12.5 | 30 | — | — | 2 |
| Test 3-2 | FIG. 4A | 35 | 27 | 77.1 | 40 | 4 | 10 | 5 | 12.5 | 60 | — | — | 3 |
| Test 3-3 | FIG. 4A | 35 | 27 | 77.1 | 40 | 4 | 10 | 5 | 12.5 | 80 | — | — | 4 |
| Test 3-4 | FIG. 4A | 35 | 27 | 77.1 | 40 | 4 | 10 | 5 | 12.5 | 90 | — | — | 4 |
| Test 3-5 | FIG. 4A | 35 | 27 | 77.1 | 40 | 4 | 10 | 5 | 12.5 | 100 | — | — | 4 |
| Test 3-6 | FIG. 4A | 35 | 27 | 77.1 | 40 | 4 | 10 | 5 | 12.5 | 120 | — | — | 3 |
| Test 3-7 | FIG. 4A | 35 | 27 | 77.1 | 40 | 4 | 10 | 5 | 12.5 | 170 | — | — | 2 |
| Test 4-1 | FIG. 1C | 35 | 27 | 77.1 | 40 | 4 | 10 | 4 | 10 | — | 1 | — | 4 |
| Test 4-2 | FIG. 1C | 35 | 27 | 77.1 | 40 | 4 | 10 | 4 | 10 | — | 20 | — | 4 |
| Test 4-3 | FIG. 1C | 35 | 27 | 77.1 | 40 | 4 | 10 | 4 | 10 | — | 45 | — | 4 |
| Test 4-4 | FIG. 1C | 35 | 27 | 77.1 | 40 | 4 | 10 | 4 | 10 | — | 60 | — | 4 |
| Test 4-5 | FIG. 1C | 35 | 27 | 77.1 | 40 | 4 | 10 | 4 | 10 | — | 80 | — | 3 |
| Test 5 | FIG. 1D | 35 | 27 | 77.1 | 40 | 4 | 10 | 5 | 12.5 | — | — | ≈0 | 4 |
| Test 6 | FIG. 17 | 20.0 | 11 | 55.0 | 25 | 3 | 12.0 | 3 | 12.0 | 90 | — | — | 4 |
| Test 7 | FIG. 11 | 85.0 | 31 | 36.5 | 85 | 4 | 4.7 | 4 | 4.7 | 90 | — | — | 4 |
| Comp. Ex. 1 | FIG. 3A | 3.5 | — | — | 4 | — | — | — | — | — | — | — | 1 |

The present disclosure includes the technical concepts and implementations described below. To facilitate understanding, reference characters may be given to the following description. Such reference characters are not intended to be restrictive.

Implementation 1: A packaged article including: a packing bag including an inlet that has a flow passage, through which the content flows; and a weak sealant section configured to define the flow passage and the container compartment.

Implementation 2: A method for using the packaged article, the method including opening the packaged article by pressing the primary container section with a finger of a hand.

Implementation 3: A packaged article (11) including: a flexible bag (12) that includes an outlet (14*b*) and a hermetic compartment (21); and a fluid content (C) contained in the hermetic compartment (21), wherein the flexible bag (12) includes a first flexible panel (12*a*), a second flexible panel (12*b*) overlapped with the first flexible panel (12*a*), a weak welded strip (32) that is a first welded strip and that includes two ends and an intermediate portion, which is located between the two ends, wherein the weak welded strip (32) welds the first panel and the second panel between the hermetic compartment (21) and the outlet (14*b*) with a first welding strength so that the content (C) does not flow out of the hermetic compartment (21) toward the outlet (14*b*), and a strong welded seal (33) that is a second welded strip and which welds the first panel and the second panel with a second welding strength, which is greater than the first welding strength, wherein the strong welded seal (33) cooperates with the weak welded strip (32) to define the hermetic compartment (21), wherein at least a portion of the strong welded seal (33) is a discharge direction stabilizing means (33*c*, 33*d*) that extends from proximity of one or both of the two ends of the weak welded strip (32) toward the intermediate portion of the weak welded strip (32) and also extends away from the outlet (14*b*).

Implementation 4: The packaged article (11) according to implementation 3, wherein the discharge direction stabilizing means (33*c*, 33*d*) has a geometric shape configured to prevent bending of the flexible bag (12) in a local region located proximate to the weak welded strip (32).

Implementation 5: The packaged article (11) according to implementation 3 or 4, wherein the discharge direction stabilizing means (33*c*, 33*d*) is out of contact with at least the intermediate portion of the weak welded strip (32) so that at least the intermediate portion of the weak welded strip (32) directly contacts the content (C) contained in the hermetic compartment (21).

Implementation 6: The packaged article (11) according to implementation 5, wherein the discharge direction stabilizing means (33*c*, 33*d*) is in contact or continuous with one end of the weak welded strip (32) and spaced apart from another end of the weak welded strip (32).

Implementation 7: The packaged article (11) according to implementation 5, wherein the discharge direction stabilizing means (33*c*, 33*d*) directly contacts the two ends of the weak welded strip (32).

Implementation 8: The packaged article (11) according to implementation 5, wherein the discharge direction stabilizing means (33*c*, 33*d*) is spaced apart from the two ends and the intermediate portion of the weak welded strip (32) so that the two ends and the intermediate portion of the weak welded strip (32) directly contact the content (C) contained in the hermetic compartment (21).

Implementation 9: The packaged article (11) according to any one of implementations 3 to 8, wherein the hermetic compartment (21) includes a primary container section (22) and a secondary container section (23), which includes a narrow neck, and the secondary container section (23) and the discharge direction stabilizing means (33*c*, 33*d*) are located between the primary container section (22) and the weak welded strip (32).

The embodiments and modified examples may be combined or replaced with each other. The operation and advantages obtained by such combination or replacement should be apparent to those skilled in the art from the disclosure of the specification and the drawings. The present invention is not limited to the exemplified examples. For example, the exemplified features should not be understood as being essential to the present invention, and the subject matter of the present invention may exist in fewer features than all features of a certain one of the disclosed embodiments.

DESCRIPTION OF REFERENCE CHARACTERS

11) packaged article, 12) packing bag, 21) container section, 21*a*) first inner edge, 22) primary container section, 23) secondary container section, 31) welded portion, 32) weak sealant section, 33) strong sealant section, 33*c*) first sealant section 33*d*) second sealant section, C) content, Y) width-wise direction, SL1) first straight portion, SL2) second straight portion, SL3) third straight portion, TL1) first tangent line, TL2) second tangent line, TL3) third tangent line, θ1) first angle, θ2) second angle, θ3) third angle

The invention claimed is:

1. A packaged article comprising:

a packing bag including an outlet and a welded portion formed by welding predetermined portions of inner surfaces of first and second flexible panels in a thickness direction of the first and second flexible panels, and structured to hermetically seal a container compartment, the container compartment being structured to contain fluid within the container compartment, wherein the welded portion includes a first sealant section having a first welding strength and configured to be parted in the thickness direction such that the inner surfaces of the first and second flexible panels, which form the first sealant section, are at least partly separated in the thickness direction to form a fluid-passing space therebetween and to force the fluid from the container compartment through the fluid-passing space and the outlet when the container compartment is pressed in the thickness direction to communicate the container compartment and an exterior of the packing bag, and a second sealant section having a second welding strength which is greater than the first welding strength of the first sealant section and configured to maintain a welded state when the first sealant section is parted in the thickness direction and the inner surfaces of the first and second flexible panels which form the first sealant section are at least partly separated in the thickness direction to form the fluid-passing space therebetween when the container compartment is pressed in the thickness direction to communicate the container compartment and the exterior of the packing bag, the container compartment includes a primary container section and a secondary container section, the secondary container section includes a narrow neck that is narrower than the primary container section in a width-wise direction, which corresponds to a direction in which the first sealant section extends, the secondary container section is in communication with the primary container section at the narrow neck, the narrow neck including a portion that has a constant width as measured in the width-wise direction, and the secondary container section is located adjacent to the first sealant section, wherein the first sealant section is arranged between the secondary container section and the outlet, which is unsealed and opens to fluidly communicate with the exterior of the packing bag in a state in which the first sealant section is closed in the thickness direction.

2. The packaged article according to claim 1, wherein when a maximum width of the primary container section is set as 100%, a minimum width of the narrow neck of the secondary container section is in a range of 30% or greater and 90% or less.

3. The packaged article according to claim 1, wherein when a maximum width of the primary container section is set as 100%, a minimum width of the narrow neck of the secondary container section is in a range of 65% or greater and 90% or less.

4. The packaged article according to claim 1, wherein the secondary container section is one of a first secondary container section, which is formed by the narrow neck that has the constant width, or a second secondary container section, which includes a portion that is wider than a minimum width and located between a part of the narrow neck having the minimum width and the first sealant section.

5. The packaged article according to claim 1, wherein the secondary container section includes a first secondary container section, which is formed by the narrow neck that has the constant width, and a second secondary container section, which includes a portion that is wider than a minimum width and located between a part of the narrow neck having the minimum width and the first sealant section.

6. The packaged article according to claim 1, wherein the narrow neck of the secondary container section has a shape narrowed from opposite sides of the primary container section in the width-wise direction.

7. The packaged article according to claim 1, wherein the narrow neck of the secondary container section is symmetrical with respect to an imaginary plane that is orthogonal to the width-wise direction.

8. The packaged article according to claim 1, wherein when a maximum height of the container compartment is set as 100%, a maximum height of the secondary container section is in a range of 2.5% or greater and 35% or less.

9. The packaged article according to claim 1, wherein when a maximum height of the container compartment is set as 100%, a maximum height of the secondary container section is in a range of 5% or greater and 15% or less.

10. The packaged article according to claim 1, wherein an edge of the second sealant section defining the narrow neck of the secondary container section satisfies at least one of condition A, condition B, or condition C described below, condition A: the edge includes a first straight portion and a second straight portion, which is non-parallel to the first straight portion, in a front view, and the first straight portion and the second straight portion form a first angle $\theta 1$ of $30° \leq \theta 1 < 180°$, condition B: the edge includes only a curved portion in the front view, and a first tangent line at any point of the curved portion intersects with a second tangent line at another any point of the curved portion at a second angle $\theta 2$ having a minimum angle of $\theta 2 < 90°$, and condition C: the edge includes a curved portion and a straight portion in the front view, and a tangent line at any point of the curved portion and the straight portion form a third angle $\theta 3$ having a minimum angle of $\theta 3 < 90°$.

11. The packaged article according to claim 10, wherein the first angle $\theta 1$ is in a range of $60° \leq \theta 1 \leq 120°$.

12. The packaged article according to claim 10, wherein the first angle $\theta 1$ is in a range of $80° \leq \theta 1 \leq 100°$.

13. The packaged article according to claim 10, wherein the minimum angle is in a range of $\theta 2 \leq 60°$.

14. The packaged article according to claim 1, wherein the portion of the narrow neck having the constant width extends in a height-wide direction, which is orthogonal to the width-wise direction.

15. The packaged article according to claim 14, wherein the narrow neck of the secondary container section includes a right-angle corner proximate to the primary container section.

16. The packaged article according to claim 14, wherein the narrow neck of the secondary container section includes a curved portion that is proximate to the primary container section and is continuous with the portion having the constant width.

17. The packaged article according to claim 1, wherein the second sealant section includes a longitudinal sealant section, which extends in a height-wise direction, which is orthogonal to the width-wise direction, and a first lateral sealant section, which projects from the longitudinal sealant section in the width-wise direction, the first sealant section includes two opposing longer sides, each extending in the width-wise direction, and two opposing shorter sides, each extending in the height-wise direction, the longitudinal sealant section is in direct contact with one of the two opposing shorter sides of the first sealant section, and the first lateral sealant section is in direct contact with one of the two opposing longer sides of the first sealant section.

18. The packaged article according to claim 1, wherein the first sealant section is a strip including two opposing ends and two opposing longer sides, each extending between the two opposing ends in the width-wise direction, and the second sealant section includes an L-shaped corner that is in direct contact with one of the two opposing longer sides of the first sealant section and with one of the two opposing ends of the first sealant section.

19. A packaged article comprising:

a flexible bag that includes an outlet and a hermetic compartment;

the hermetic compartment being structured to contain fluid within the hermetic compartment, wherein the flexible bag includes a first flexible panel, a second flexible panel overlapped with the first flexible panel, a first welded strip including two ends and an intermediate portion, which is located between the two ends, wherein the first welded strip welds the first flexible panel and the second flexible panel between the hermetic compartment and the outlet with a first welding strength so that the fluid does not flow out of the hermetic compartment toward the outlet, and a second welded seal that welds the first flexible panel and the second flexible panel with a second welding strength, which is greater than the first welding strength, wherein the second welded seal cooperates with the first welded strip to define the hermetic compartment, wherein the hermetic compartment includes a primary container section and a secondary container section, which includes a narrow neck, wherein at least a portion of the second welded seal is a discharge direction stabilizer that extends proximate from one or both of the two ends of the first welded strip toward the intermediate portion of the first welded strip and extends away from the outlet to form the narrow neck of the secondary container section, wherein the discharge direction stabilizer includes a top edge of the portion of the second welded seal that is spaced apart from the two ends and the intermediate portion of the first welded strip in a direction away from the outlet such that the hermetic compartment further includes a non-narrowed compartment portion between the secondary container section and the first welded strip, the non-narrowed compartment portion and the outlet having a same constant width, which is wider than a width of the narrow neck, and wherein the two ends and the intermediate portion of the first welded strip and the top edge of the discharge direction stabilizer are arranged so as to directly contact the fluid contained in the hermetic compartment.

20. The packaged article according to claim 19, wherein the discharge direction stabilizer has a geometric shape configured to prevent bending of the flexible bag in a local region located proximate to the first welded strip.

21. The packaged article according to claim 19, wherein part of the discharge direction stabilizer is out of contact with at least the intermediate portion of the first welded strip so that at least the intermediate portion of the first welded strip is arranged to directly contact the fluid contained in the hermetic compartment.

22. The packaged article according to claim 21, wherein the discharge direction stabilizer coincides with one end of the first welded strip and is spaced apart from another end of the first welded strip.

23. The packaged article according to claim 21, wherein the discharge direction stabilizer coincides with the two ends of the first welded strip.

24. The packaged article according to claim 19, wherein the secondary container section and the discharge direction stabilizer are located between the primary container section and the first welded strip.

* * * * *